US008857635B2

(12) United States Patent
Weckbecker et al.

(10) Patent No.: US 8,857,635 B2
(45) Date of Patent: Oct. 14, 2014

(54) CRANE AND METHOD FOR OPERATING A CRANE USING RECOVERY OF ENERGY FROM CRANE OPERATIONS AS A SECONDARY ENERGY SOURCE

(75) Inventors: Alfons Weckbecker, Zweibrücken (DE); Marc Krebs, Rohrbach-lès-Bi (FR); Axel Beckmann, Saarbrücken (DE); Frank Schnittker, Zweibrücken (DE); Steffen Helfrich, Saalstadt (DE)

(73) Assignee: Terex Cranes Germany GmbH, Zweibruecken (DE)

( * ) Notice: Subject to any disclaimer, the term of this patent is extended or adjusted under 35 U.S.C. 154(b) by 693 days.

(21) Appl. No.: 12/976,403

(22) Filed: Dec. 22, 2010

(65) Prior Publication Data

US 2012/0160796 A1 Jun. 28, 2012

(51) Int. Cl.

| | |
|---|---|
| ***B66C 13/12*** | (2006.01) |
| ***B66D 1/22*** | (2006.01) |
| ***B66C 13/28*** | (2006.01) |
| ***B66D 1/12*** | (2006.01) |
| ***B66C 23/76*** | (2006.01) |

(52) U.S. Cl.

CPC . *B66C 13/28* (2013.01); *B66D 1/22* (2013.01); *B66D 1/12* (2013.01); *B66C 23/76* (2013.01)

USPC ..... 212/284; 212/270

(58) Field of Classification Search

CPC ..... B66C 13/14; B66C 13/23; B66C 13/28; B66C 13/48; B60L 11/002; B60L 11/08; B60L 11/18; Y02T 10/7044

USPC ..... 212/284, 270, 271; 320/104, 149; 60/698, 719, 720

See application file for complete search history.

(56) References Cited

U.S. PATENT DOCUMENTS 2,232,587 A * 2/1941 Brandt ..... 237/5
5,367,455 A * 11/1994 Kitagawa et al. ..... 701/22

(Continued)

FOREIGN PATENT DOCUMENTS

DE 4008370 A1 9/1999
DE 200 10 030 U1 11/2000

(Continued)

OTHER PUBLICATIONS

JPO Machine Translation of JP 2001-163574 A from http://www.ipdl.inpit.go.jp Jul. 26, 2013.*

(Continued)

*Primary Examiner* — Emmanuel M Marcelo
*Assistant Examiner* — Justin Stefanon
(74) *Attorney, Agent, or Firm* — Browdy and Neimark, PLLC

(57) ABSTRACT

A crane, in particular a large crane, including a power consumer system for providing energy, a primary energy source for feeding primary energy into the power consumer system, at least one secondary energy source, independent of the primary energy source, for feeding secondary energy into the power consumer system, at least one energy storage unit arranged locally on the crane and is, in particular, associated with the at least one crane component and connected to the power consumer system for storing primary energy and/or secondary energy, at least one drive motor connected to the power consumer system for operating at least one crane component and a secondary energy source configured such that energy returned from the crane operation is at least partially fed as secondary energy into the power consumer system. The at least one crane component is configured as a secondary energy source for energy recovery.

8 Claims, 10 Drawing Sheets

(56) References Cited

U.S. PATENT DOCUMENTS

| | | | | |
|---|---|---|---|---|
| 5,936,375 | A * | 8/1999 | Enoki | 318/727 |
| 5,991,677 | A * | 11/1999 | Kinugawa et al. | 701/50 |
| 6,688,481 | B1 | 2/2004 | Adner et al. | |
| 7,554,278 | B2 | 6/2009 | Wegner-Donnelly et al. | |
| 2003/0151387 | A1* | 8/2003 | Kumar | 320/104 |
| 2006/0076171 | A1* | 4/2006 | Donnelly et al. | 180/65.225 |
| 2008/0048497 | A1* | 2/2008 | Donnelly et al. | 307/19 |
| 2008/0230618 | A1* | 9/2008 | Gawthrop | 237/12.3 B |
| 2008/0246338 | A1* | 10/2008 | Donnelly et al. | 307/54 |
| 2008/0246436 | A1 | 10/2008 | Fischer et al. | |
| 2009/0100830 | A1 | 4/2009 | Schneider et al. | |
| 2009/0256125 | A1 | 10/2009 | Graner et al. | |
| 2011/0180770 | A1 | 7/2011 | Karambelas et al. | |
| 2012/0082536 | A1* | 4/2012 | Kawashima et al. | 414/694 |

FOREIGN PATENT DOCUMENTS

| | | | |
|---|---|---|---|
| DE | 199 48 831 | B4 | 6/2005 |
| DE | 10 2004 010 988 | A1 | 9/2005 |
| DE | 10 2007 046696 | A1 | 4/2009 |
| DE | 20 2008 004 985 | U1 | 9/2009 |
| DE | 10 2009 057 240 | A1 | 6/2011 |
| EP | 1 813 462 | A1 | 8/2007 |
| EP | 2065331 | A2 | 6/2009 |
| GB | 2 352 709 | B | 3/2003 |
| JP | 20010163574 | A | 6/2001 |
| WO | 2010101832 | A2 | 9/2010 |

OTHER PUBLICATIONS

Rubber Tired Gantry (RTG) Crane Load Factor Study, Starcrest Consulting Group LLC, Oct. 2009, http://www.polb.com/civica/filebank/blobdload.asp?BlobID=6915.*

International Search Report for PCT/EP2011/071983 dated Jul. 12, 2012.

German Patent Application No. 10 2010 063 911 Office Action dated Nov. 21, 2011.

* cited by examiner

CRANE AND METHOD FOR OPERATING A CRANE USING RECOVERY OF ENERGY FROM CRANE OPERATIONS AS A SECONDARY ENERGY SOURCE

FIELD

The invention relates to a crane, in particular a large crane, and a method for operating a crane, and in particular electrically operated cranes.

BACKGROUND

Large cranes have been known for a long time through public prior use. Working machines of this type are used, for example, to lift loads and, to satisfy complex operating sequences, have a large number of drives and assemblies, which may have a cumulative power of up to 1000 kW. The energy consumption and the emitted pollutants of a crane of this type are correspondingly high.

A load-lifting device is known from U.S. Pat. No. 7,554,278 B2, to Wegner-Donnelly et al., which uses recovered energy, which is released, for example, on lowering a load, for the energy supply of the device. U.S. Pat. No. 5,936,375 to Enoki discloses a method for storing and reusing energy for a load-lifting system. The energy storage is based on batteries, which, because of their limited storage capacity may be extended, for example, by a flywheel. This form of energy storage is complex and, because of the increased component number, is associated with higher energy losses.

The Liebherr patent DE 10 2007 046 696 A1 to Schneider discloses a hydraulic operated crane with hybrid capabilities. However, hydraulically operated cranes are difficult to control and determine in advance the amount of energy needed to operate the crane, and the methods taught for use in hydraulically operated cranes will not work for electrically operated cranes.

SUMMARY

An object of the invention is to modify a crane in such a way that the fuel consumption as well as the emission of exhaust gases and noise are reduced, in particular taking into account an intermittent operation mode that is typical for a large mobile crane.

According to one embodiment, a crane is provided comprising a power consumer system for providing energy; a primary energy source for feeding primary energy into the power consumer system; at least one secondary energy source, controllable independent from the primary energy source, for feeding secondary energy into the power consumer system, wherein the secondary energy source is connected to the power consumer system, and configured such that energy returned from operation of the at least one secondary energy source is at least partially fed as secondary energy into the power consumer system, said secondary energy source comprising at least one crane component, at least one energy storage unit arranged locally on the crane associated with the at least one crane component and connected to the power consumer system for storing primary energy and/or secondary energy; and at least one drive motor connected to the power consumer system for operating the at least one crane component in response to energy fed into the power consumer system.

According to one embodiment, a control unit is provided, which is in signal connection with the power consumer system, the primary energy source and the at least one secondary source to control energy supply to the at least one crane component.

According to one embodiment, a data bus is provided that enables bidirectional data transfer, the data bus being connected to the control unit and further to the power consumer unit to provide electrical input and output variables to the control unit.

According to one embodiment, the primary energy source is configured to be activated when a start condition is fulfilled and is configured to be deactivated when a stop condition is fulfilled.

According to one embodiment, the stop condition is fulfilled when at least one of the following conditions is met a) no demand for hydraulic power is detected; b) a battery voltage within predetermined limits is detected; c) a cooling water temperature of the primary energy source is detected to be within limit values; d) temperature of pressure oil is detected to be within limit values; e) when only auxiliary components connected to receive energy solely from the secondary energy source are turned on; and f) other predetermined stop conditions set by a user.

According to one embodiment, the primary energy source comprises an internal combustion engine, a gear connected by a clutch to the internal combustion engine, and a generator.

According to one embodiment, the primary energy source comprises a diesel engine.

According to one embodiment, the crane further includes auxiliary crane components connected to the power consumer system to receive energy solely from the secondary energy source.

According to one embodiment, the crane further includes at least one fuel cell connected to said primary energy source to supplement the energy output from the primary energy source.

According to one embodiment, the at least one crane component comprises a rotary mechanism or a hydraulic or electric linear drive, an energy converter, and an electric motor.

According to one embodiment, the energy converter comprises a consumer gear or a hydraulic pump. According to one embodiment, the crane further includes at least one power consumer connected to the power consumer system, which system supplies energy to the at least one power consumer from the primary energy source.

According to one embodiment, the crane further includes at least one power consumer connected to the power consumer system, which system supplies energy to the at least one power consumer from the at least one secondary energy source.

According to one embodiment, the at least one secondary source comprises an internal combustion engine.

According to one embodiment, the crane further including a primary energy source radiator for cooling the primary energy source, and a secondary energy source radiator in cooling connection with the primary energy source radiator for cooling at least one of the primary energy source and the secondary energy source.

According to one embodiment, in an emergency operation, the control unit is configured to cause energy to be supplied to the crane from the secondary power source.

According to one embodiment, the primary energy source includes a diesel engine, at least two primary source generators to convert mechanical energy from the diesel engine to electric energy to be fed via rectifiers into the power consumer system, and a clutch and gear connected together and between the diesel engine and the at least two primary source generators to transmit the mechanical energy from the diesel engine to the at least two primary energy source generators.

According to one embodiment, the crane further includes a cooling water supply connected to the rectifiers and the primary energy source generators.

According to one embodiment, the crane further includes an undercarriage, a superstructure rotatably arranged on the undercarriage, a hydraulic pump, a plurality of hydraulic cylinders connected to support the undercarriage, a converter, an electric motor connected to the hydraulic pump, the converter and the power consumer system to convert power supplied from the power consumer system to hydraulic energy to be supplied to the hydraulic pump to control positioning of the undercarriage.

According to one embodiment, the crane further including a superlift mast on the superstructure, a pressure transmitter connected to the superlift mast to detect and transmit an angular position of the superlift mast to the control unit.

According to one embodiment, the at least one crane component comprises at least one rotary device, a corresponding rotary gear connected to the at least one rotary device, corresponding at least one electric motor connected to the at least one rotary gear for converting rotary movement from the at least one rotary gear into electric energy, and a converted connected to the at least one corresponding electric motor to feed the electric energy to the power consumer system.

According to one embodiment, the crane further including an external energy supply configured to supply mains power to the power consumer system.

According to one embodiment, the at least one crane component comprises at least one rotary device, and the crane further comprises a central switch-over unit connected to each of the at least one rotary devices and the power consumer system for converting the rotary movement of the at least one rotary devices to electric energy to be supplied as secondary energy to the power consumer system.

According to one embodiment, the power consumer system comprises two power lines.

According to one embodiment, the crane comprises a cable winch, the cable winch comprising a cable drum having a central cavity, an electric motor having a drive shaft extending along a central longitudinal axis of the central cavity, a first winch holder to connect the winch to the electric motor, a gear housing connected near a distal end of the drive shaft, a fixed planetary gear connected to the gear housing and the drive shaft, a second winch holder connected to the fixed planetary gear at a side opposite from the gear housing, and a brake connected to an end of the drive shaft and at an opposite side of the winch holder from the planetary gear. The electric motor and gear are capable of driving the winch to wind a cable on the cable drum to lift a load, and the electric motor operates as a generator for generating electric power when the cable is driven by the gear and drive shaft to lower the load.

According to one embodiment, the crane further includes an angle transmitter connected to the superstructure to detect and transmit an angular position of the superstructure to the control unit.

A crane according to another embodiment has a secondary energy storage unit, arranged centrally on the crane for storing excess energy from at least one of the primary energy source and the secondary energy source.

According to one embodiment, the second energy storage unit comprises a battery arrangement arranged as a stackable counter-weight on the crane.

According to one embodiment, the second energy storage unit comprises a battery arrangement arranged as a superlift counter-weight on a counter-weight carriage separated from the crane.

According to one embodiment, the secondary energy source has a maximally available secondary output $P_{S,max}$ that is smaller than a maximally available primary output $P_{P,max}$ of the primary energy source (12), and wherein $P_{S,max} \leq 0.5 \cdot P_{P,max}$.

According to one embodiment, the control unit comprises a non-transitory computer readable medium storing software that performs the steps of providing a total energy amount comprising at least one of primary energy generated by means of the primary energy source and secondary energy generated by means of the at least one secondary energy source; determining an energy usage fraction demanded by the at least one crane component; and storing an energy storage fraction in the at least one energy storage unit, wherein the total energy amount comprises the energy usage fraction and the energy storage fraction, and wherein the secondary energy is energy returned from operations performed by the at least one crane components.

According to one embodiment, the software performs the following step of causing energy to be supplied to meet the energy usage fraction from the energy storage unit in preference over energy supplied from the primary energy source.

According to one embodiment, the software comprises the step of controlling the supply of energy to predetermined crane components in preference over other predetermined crane components.

According to one embodiment, the software performs the steps of activating, in a working operation of the crane, at least one crane component; deactivating in a no-load operation of the crane, the at least one crane component; and controlling operation of the crane such that in an intermittent operation, a ratio of operating period in the working operation to operating period in the no-load operation is at most 0.3.

According to one embodiment, the software performs the step of providing the energy usage fraction to the at least one crane component by causing energy to be fed into the power consumer system.

According to one embodiment, the crane further comprises at least one energy converter connected to the at least one crane component to convert energy from the at least one crane component into power, and wherein said software performs the step of providing the energy usage fraction to the at least one crane component using the power from the at least one energy converter.

According to one embodiment, the control unit controls a ratio of the energy usage fraction to the energy storage fraction.

According to one embodiment, the control unit determines an excess energy fraction such that a sum of the energy usage fraction and a maximum energy storage fraction is equal to a sum of the excess energy fraction and the total energy amount.

According to one embodiment, the control unit controls reduction of the excess energy fraction by converting energy obtained from additional brake resistances into thermal energy, a return of the thermal energy to the crane being used to heat a crane cabin.

According to one embodiment, the software performs the following step of causing energy to be supplied to meet the energy usage fraction from the energy storage unit in preference over energy supplied from the primary energy source.

According to one embodiment, the software comprises the step of controlling the supply of energy to predetermined crane components in preference over other predetermined crane components.

A further object of the invention is to modify a method for operating a crane in such a way that it can be operated with a reduced fuel consumption and reduced emission of exhaust gases and noise.

This object is achieved according to the invention by a method which comprises activating, in a working operation of the crane, at least one crane component; deactivating, in a no-load operation of the crane, the at least one crane component; controlling operation of the crane such that in an intermittent operation, a ratio of operating period in the working operation to operating period in the no-load operation is at most 0.3; providing a total energy amount comprising at least one of primary energy generated by means of the primary energy source and secondary energy generated by means of a at least one secondary energy source; determining an energy usage fraction demanded by at least one crane component, wherein the at least one crane component is configured as a secondary energy source for energy recovery; and storing an energy storage fraction in the at least one energy storage unit, wherein the total energy amount comprises the energy usage fraction and the energy storage fraction, and wherein the secondary energy is energy returned from operations performed by the at least one crane components.

In a method according to one embodiment, the energy usage fraction is provided to the at least one crane component by feeding into the power consumer system. According to another embodiment, the energy usage fraction is provided by means of at least one energy converter connected to the at least one crane component to convert energy from operation of the at least one crane component into power.

According to one embodiment, a ratio of the energy usage fraction to the energy storage fraction is controlled by means of a control unit.

According to one embodiment, an excess energy fraction is determined by means of the control unit such, that a sum of the energy usage fraction and a maximum energy storage fraction is equal to a sum of the excess energy fraction and the total energy amount.

According to one embodiment, a reduction of the excess energy fraction is controlled by converting energy obtained from additional brake resistances into thermal energy, a return of the thermal energy to the crane being used to heat a crane cabin.

According to one embodiment, a method of operating a crane comprises providing energy to at least one crane component using a power consumer system, feeding primary energy into the power consumer system using a primary energy source, operating the at least one crane component using at least one drive motor connected to the power consumer system, feeding secondary energy into the power consumer system by recovering the secondary energy from operation of the at least one crane component as a secondary energy source, controllable independent from the primary energy source, and storing at least one of primary energy and secondary energy using at least one energy storage unit arranged locally on the crane and connected to the power consumer system.

According to one embodiment, a method for operating a crane is provided. The crane comprises at least one crane component, a primary energy source, at least one secondary energy source, and a power consumer system connected to the a least one crane component the primary energy source and the at least one secondary energy source for supplying energy from at least one of the primary energy source and the at least one secondary energy source to the at least one crane component. The method comprising the steps of providing a total energy amount comprising at least one of primary energy generated by means of a primary energy source and secondary energy generated by means of at least one secondary energy source; determining an energy usage fraction demanded by the at least one crane component; and storing an energy storage fraction in at least one energy storage unit, wherein the total energy amount comprises the energy usage fraction and the energy storage fraction, and wherein the secondary energy is energy returned from operations performed by the at least one crane components.

According to one embodiment, the method further includes the steps of activating, in a working operation of the crane, at least one crane component; deactivating in a no-load operation of the crane, the at least one crane component; and controlling operation of the crane such that in an intermittent operation, a ratio of operating period in the working operation to operating period in the no-load operation is at most 0.3.

According to one embodiment, the method includes the step of providing the energy usage fraction to the at least one crane component by causing energy to be fed into the power consumer system.

According to one embodiment, the method further comprises the steps of converting energy from operation of the at least one crane component into power using at least one energy converter connected to the at least one crane component, and providing the energy usage fraction to the at least one crane component using the power from the at least one energy converter.

According to one embodiment, the method further includes the step of controlling the supply of energy to the at least one crane component by controlling a ratio of the energy usage fraction to the energy storage fraction.

According to one embodiment, the method further includes the step of determining an excess energy fraction such that a sum of the energy usage fraction and a maximum energy storage fraction is equal to a sum of the excess energy fraction and the total energy amount.

According to one embodiment, the method further includes the step of reducing the excess energy fraction by converting energy obtained from additional brake resistances into thermal energy, a return of the thermal energy to the crane being used to heat a crane cabin.

According to one embodiment, the control unit is capable of selectively controlling operation of the crane in four modes, the four modes being a standby mode, a semi-hybrid mode, a full-hybrid mode, and a full electric mode.

According to one embodiment, in the standby mode, at least one auxiliary functions can be activated by the secondary energy source during a stop function when the primary energy source is deactivated.

According to one embodiment, in the semi-hybrid mode, both the primary energy source and electric drives for the at least one crane component are used to generate energy to be used to run the crane.

According to one embodiment, in the full-hybrid mode, energy reserves stored in the energy storage unit or electric energy from the secondary energy sources are used preferentially over energy supplied from the primary energy source to run the crane.

According to one embodiment, in the full electric mode, only electric energy sources are used to run the crane.

According to one embodiment, the crane further includes an input device to allow a crane operator to switch between the four modes.

According to one embodiment, the control unit comprises a module to automatically determine which of the four modes should be used and to cause the control unit to switch to the predetermined mode.

According to one embodiment, a cable winch includes a cable drum having a central cavity, an electric motor having a drive shaft extending along a central longitudinal axis of the central cavity, a first winch holder to connect the winch to the electric motor, a gear housing connected near a distal end of the drive shaft, a fixed planetary gear connected to the gear housing and the drive shaft, a second winch holder connected to the fixed planetary gear at a side opposite from the gear housing, and a brake connected to an end of the drive shaft and at an opposite side of the winch holder from the planetary gear. The electric motor and gear are capable of driving the winch to wind a cable on the cable drum to lift a load, and the electric motor operates as a generator for generating electric power when the cable is driven by the gear and drive shaft to lower the load.

BRIEF DESCRIPTION OF THE DRAWINGS

Embodiments of the invention will be described in more detail below with the aid of the drawings, in which.

GENERAL DESCRIPTION

Figure 1:
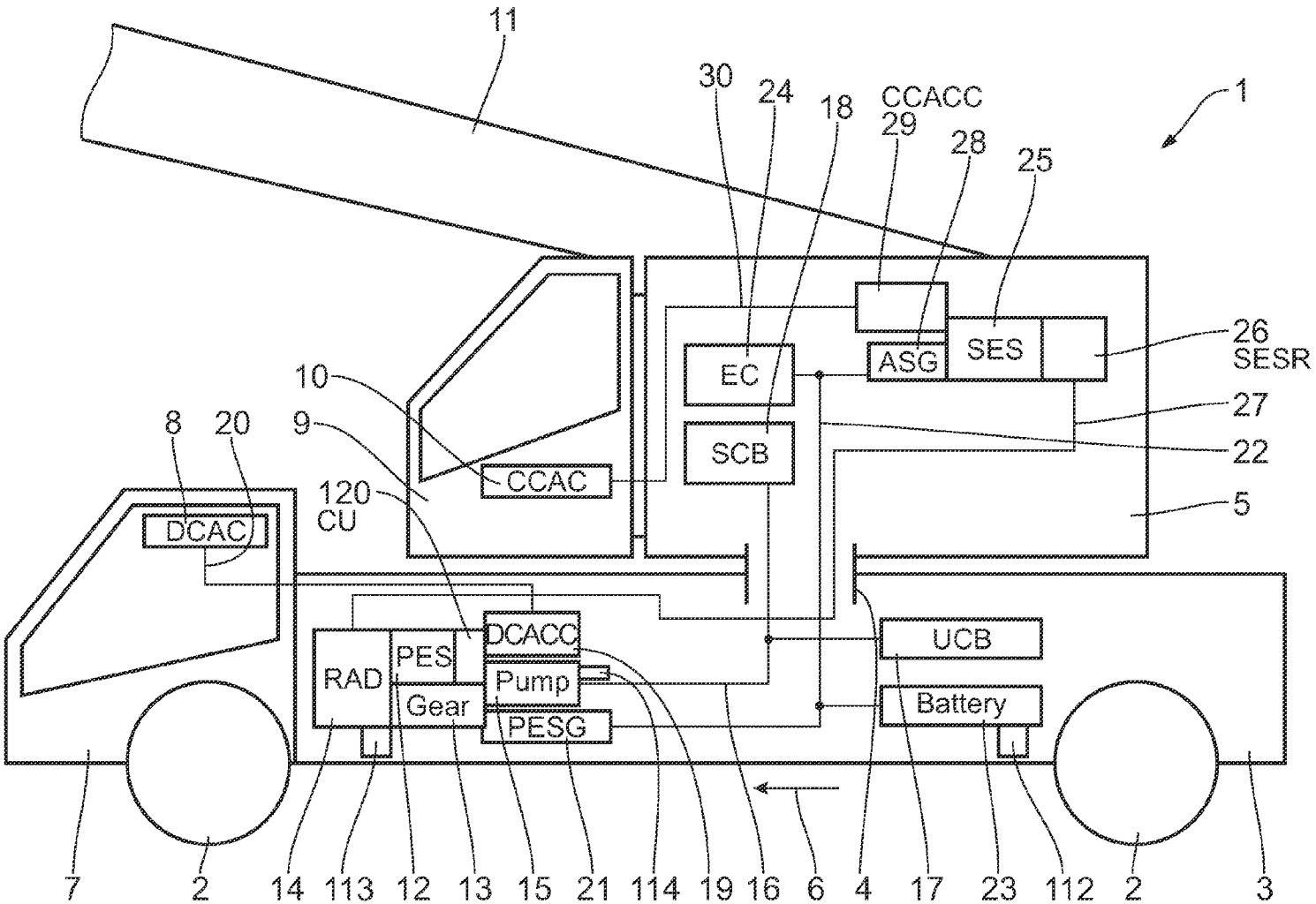
FIG. 1 shows a schematic side view of a crane with tyres according to the invention according to a first embodiment with a secondary energy source arranged in a superstructure of the crane and a telescopic boom.

According to the invention a crane, apart from a primary energy source for feeding primary energy into a power consumer system, has at least one secondary energy source, which is independent of the primary energy source, for feeding secondary energy into the power consumer system. In this case, the at least one secondary energy source is configured in such a way that energy returned from the crane operation is at least partially fed as secondary energy into the power consumer system. For example, the secondary energy source could be the crane components themselves, where energy is recovered from operation of those components. It is thereby possible to supply the necessary energy requirement to supply at least one drive motor connected to the power consumer system to operate at least one crane component with energy from the power consumer system, which has not been generated exclusively and especially by the primary energy source. It is thus possible to reduce the running time and therefore the energy consumption and the emission of pollutants of the primary energy source, which may, for example, be configured as a diesel engine. It can thus also be made possible to configure the primary energy source smaller, i.e., with a lower power capacity, than in a comparable crane without a secondary energy source.

In the crane, as noted above the at least one crane component can be used as a secondary energy source and therefore allows a functional integration of the crane. That means that the secondary energy source can be used for providing energy for the crane on the one hand and the secondary energy source can be one of the at least one crane component providing different kinds of function for the crane on the other hand. Therefore, the creation of at least one crane component as a secondary energy source allows combining the function of the crane component itself, e.g., for driving the crane, and further for providing secondary energy for the crane. A crane component that is usable as a secondary energy source integrates two different functions in one component that are usually realized by two different components. Thus, a reduction in the overall size and further an enhancement of the efficiency of the energy supply of the crane are achieved. It is possible, for example, for a winch to be used as a crane component for rolling and unrolling a cable, it being necessary for the winch to be driven by a corresponding drive motor of the crane component to roll up the cable, i.e., to lift a load. When lowering the load, i.e., when unrolling the cable, the winch is used as a secondary energy source, it being possible for the energy returned from lowering the load to be at least partially fed into the power consumer system and to be available for further use or storage. Because of the large geometry of a crane, i.e., because of long booms and large lifting heights, the latter offers a large potential for returnable secondary energy. In particular, the energy saving potential in a crane is greater than in a digger or other construction machines. Hence, several options concerning energy supply, energy return and energy storage are possible for the crane according to the invention which is built as a semi-hybrid or a full-hybrid system.

Because of the energy return, forces and energies inherent to the system available in the crane are utilised in a targeted manner. As a consequence, it is possible to equip a large crane with correspondingly large motors and/or generators to utilise a possible energy recovery potential. As, in particular, in the case of a crawler crane, the total crane weight is not of primary significance, the maximally recovered power of the secondary energy sources can exceed a currently maximum total energy amount of the crane, so the secondary energy can also be fed into an operating network. In this case, the crane is used as a power plant.

It is also possible to configure the crane in such a way that the secondary energy source is not the crane components using energy recovered from the crane operation, but is instead another separate source. The secondary energy source may, for example, be an internal combustion engine or a battery energy source, which, in comparison to the primary energy source, has a lower power. This smaller internal combustion engine may, for example, be operated independently of the primary energy source and be used in order, for example, to supply smaller electric consumers, such as an air-conditioning system or other electric consumers, with energy. Furthermore, at least one energy storage unit connected to the power consumer system may be provided to store excess primary energy and/or secondary energy. The energy storage unit may be arranged locally on the crane and, in particular, is associated with the at least one crane component. It is possible, as a result, to ensure the required energy provision for the main functions of the crane, such as, for example, lifting, travelling, rotary and/or pivoting movements of the crane close to the respective crane component. That means that a distance from a place of required energy provision to a corresponding respective crane component is reduced and in particular said distance is minimised. Usually, transmission losses are proportional to a length of a connecting line of energy transmission. As a result, transmission losses can be reduced and in particular can be avoided, so that overall efficiency of the energy supply of the crane is improved.

The energy supply of the crane can be controlled particularly effectively and efficiently in terms of energy by a control unit, which is in signal connection with the power consumer system to control the energy supply of the crane.

In this case, the control unit controls the energy requirements with regard to the necessary primary energy and/or secondary energy to be fed, for the energy usage fraction demanded by the drive motors of the crane components, as well as an energy storage fraction which can be stored in the at least one energy storage unit. In this case, for example, it may be established that the additional energy requirement is always preferentially provided from the at least one energy storage unit, before the primary energy source is caused to generate new, additional primary energy. In this way, it is possible to avoid creation of additional pollution and to reduce fuel consumption. It is furthermore possible to preferentially supply specific crane components with energy, so, for example, a lifting or holding of a load is always served preferentially compared to a travelling and/or pivoting or another combined operation of the crane. In case of a superlift operation of the crane, luffing of the jib or tilting of the main boom in conjunction with the correction of the superlift mast angle is preferred over travelling and/or pivoting or another combined operation. Further, shifting out/in of a counterweight carriage or governing an activation of a counterweight system as described in U.S. patent application Ser. No. 12/085,127, to Zollondz et al. is preferred over travelling and/or pivoting or another combined operation of the crane. In addition, the most crane safety related crane function, i.e. sustaining a safe geometry whilst lifting/lowering or rearranging the crane always rules over the procedures of any crane function.

A real-time state monitoring of the crane is possible with the control of the crane according to an embodiment in which the crane further comprises a data bus enabling bidirectional data transfer. The data bus is connected to the control unit and also to the power consumer unit to provide electrical input and output variables to the control unit. The sending and processing of electric signals as input and output variables for the control unit takes place more quickly than mechanical, fluid-mechanical, pneumatic or electro-mechanical signals.

In a configuration of the primary energy source having a start-stop function, the primary energy source is configured to be activated when a start condition is fulfilled and is configured to be deactivated when a stop condition is fulfilled. In this way, it is possible to configure the primary energy source necessary for the requirements to actuate the main crane functions, such as, for example, a lifting device and/or a travelling drive of the crane, accordingly. By means of the start-stop function, operating hours of the primary energy source can be reduced in that the stop condition of the primary energy source is fulfilled when, for example, neither the lifting device nor the travelling drive are actuated. As a result, the fuel consumption for the primary energy source configured, in particular, as a diesel engine, is reduced. Additionally, exhaust gas and noise emissions are reduced. Because of the reduced number of operating hours, the work outlay and the costs connected thereto for maintaining the primary energy source are reduced.

In addition, the secondary energy source, independent of the primary energy source, may be provided to operate auxiliary components of the crane. Auxiliary components of this type may, for example, be an air-conditioning system, cabin heating, auxiliary heating for the primary energy source, a generator, a hydraulic oil circulating pump for oil to be conveyed through an oil cooler, the oil cooler itself or further components. The auxiliary components may be connected to the power consumer system to receive energy solely from the secondary energy source. Since auxiliary components of this type may be supplied exclusively by the secondary energy source, the primary energy source may be decoupled from the auxiliary components. As a result, it is possible, in particular, for the stop condition to deactivate the primary energy source to be fulfilled more frequently and, in particular, over longer time periods. In particular, the stop condition is fulfilled and therefore the primary energy source deactivated when exclusively auxiliary components, but not main components of the crane, are being operated. It is therefore not necessary for the diesel engine configured for the maximum outputs of the crane to be managed to be operated in order, for example, to supply the air-conditioning system of the crane cabin with current. As a result of the secondary energy source providing the energy supply of the auxiliary components, the primary energy source can be designed smaller, i.e., with a smaller maximally available power. As a result, the required installation space in the crane and the weight for the primary energy source, and therefore the crane overall, are reduced. The fuel consumption during travelling operation of the crane is also additionally reduced. It is thus possible for the secondary energy source to be in operation when the primary energy source is deactivated. Likewise, the secondary energy source may be deactivated when the primary energy source is activated.

The secondary energy source may also be used to maintain the battery voltage in order to ensure adequate energy for frequent engine starts of the primary energy source. Moreover, the secondary energy source may have a motor generator, so the auxiliary components driven by the secondary energy source can additionally and/or alternatively be operated by an external energy source such as, for example, a power supply with 220 V supply voltage. The secondary energy source may be used to charge a secondary energy storage unit, for example, a hydraulic or pneumatic store, which during the start of the primary energy source, operates an assisting engine, in particular a hydraulic or a compressed air engine, as an additional starter.

A crane with a primary energy source according to one embodiment allows particularly uncomplicated handling and effective use of the crane, as the required fuel is comprehensively available. In this embodiment, the primary energy source comprises an internal combustion engine, a gear connected by a clutch to the internal combustion engine, and a generator. An increase in the efficiency of the generator coupled to the internal combustion engine may take place by means of a self-cooling system located therebehind, such as, for example, a heat exchanger to air or an air cooling system. It is furthermore possible to supplement the energy output of the internal combustion engine, alternatively, or additionally, by fuel cells or by connection to a mains operation. In this case, the emissions of the crane can be further reduced to provide operation without any emissions of carbon dioxide.

In a crane with a crane component according to another embodiment, the energy fed into the power consumer system can be used particularly efficiently and therefore with reduced loss for the drive of the crane components. In this embodiment, the primary energy source comprises a diesel engine. Rotationally driven components, such as, for example, winding mechanisms, rotary mechanisms or travel gear have proven particularly suitable here due to the large amount of inherent available energy potential because of mass inertia and rotational energy. It is also possible, to correspondingly provide linear working functions, for example by converting the electric energy by means of a hydraulic system.

It is possible with an energy storage unit according to another embodiment, to arrange a battery pack as a main energy store centrally on the crane. For example, the battery pack, because of its heavy weight, may be arranged as a stackable counter-weight on the crane as a base ballast or as a superlift counter-weight on a counter-weight carriage separated from the crane. In this embodiment, the at least one crane component comprises a rotary mechanism or a hydraulic or electric linear drive, an energy converter, and an electric motor. Thus, a counter-weight generally required separately for the crane is not necessary, as the battery arrangement can be used as the counter-weight.

A crane according to another embodiment has a secondary energy source, which, in comparison to the primary energy source, has a smaller, maximally available power. Further, the crane has a second energy storage unit, arranged centrally on the crane. Because of the correspondingly reduced requirements of the capacity of the secondary energy source, this may be correspondingly small in dimension and with a lower power. This also leads to, among other things, a further saving in weight of the crane overall.

The inventors recognised that in addition to the primary energy amount provided by the primary energy source, returned secondary energy and further energy that is stored in the energy storage units should be available via the power consumer system.

Due to the large geometry of the large crane, i.e., long jibs and large lifting heights, a crane having these features offers a large potential of returnable secondary energy. Moreover, the possible energy savings of such a crane are larger than those of a digger or other construction machines. Hence, several options concerning energy supply, energy return and energy storage result for the large crane according to the disclosed embodiments, this crane being built as a semi-hybrid or a full-hybrid system.

In a hybrid crane of the type described here, energy can be provided as potential energy of the lifted load. Larger cranes, and particularly electrically operated cranes with tall booms, are capable of generating more energy from movement of the load than are smaller boom cranes. This is because the energy is generated by the downward movement of the load, and less energy can be generated from loads moving small distances.

A return of the energy may be realized by conversion of the potential energy of the lifted load to kinetic energy by lowering the load, e.g., via rotating winches or via geometrical variations of the crane, i.e., luffing the main jib and the auxiliary jib by a hoisting gear and a luffing mechanism. Furthermore, a total energy amount is provided, which comprises the primary energy generated by means of the primary energy source and/or the secondary energy generated by means of the secondary energy source.

An energy usage fraction is the amount of energy demanded by the at least one crane component for operation thereof and an energy storage fraction is the amount of excess energy produced by the energy sources on the crane, and then stored in the at least one energy storage unit. In this case, the total energy fraction comprises the energy usage fraction and the energy storage fraction. The secondary energy is from the energy returned from the crane operation. As a result, it is possible for the primary energy source to feed only as much primary energy into the energy distribution circuit as is currently actually necessary to operate the at least one crane component. A possible excess of primary energy beyond the energy usage fraction is stored as an energy storage fraction in the at least one energy storage unit and is available for use at another time or for simultaneous use for other auxiliary functions on the crane. For this purpose, batteries or double layer capacitors may be used, for example, which are also known as ultracaps. It is thus possible with the method according to the invention to reduce the no-load operation of the crane or to avoid it, as the emission of pollutants by the primary energy source is always connected to the generation of an energy amount for the energy usage fraction. Using a maximum load control limiter, the energy usage fraction is detected as the energy amount that is necessary for providing all functions and motions of the crane. Since the crane components preferably comprise electrical drives, this detection is carried out rapidly and directly and therefore more easily than it could be done for a crane with hydraulic drives.

Different control characteristics are necessary to operate a crane with hybrid drive systems in intermittent operation than are required to operate it in continuous operation. No-load operation therefore means that energy is expended to operate the primary energy source without a corresponding utilisation by a load connected therewith. Thus, under the no-load operation, for example, no load is lifted or held, no load is displaced into position, no load is moved, no load is lowered or deposited and the crane is not moved.

Thus, according to one embodiment provides for activating, in a working operation of the crane, at least one crane component; deactivating in a no-load operation of the crane, the at least one crane component; and controlling operation of the crane such that in an intermittent operation, a ratio of operating period in the working operation to operating period in the no-load operation is at most 0.3. According to the invention, it was recognised that the energy supply of a crane in continuous operation cannot easily be transferred to a crane driven intermittently. In continuous operation, the crane is virtually continuously operated under load, so a permanent power supply is necessary to operate crane components. Accordingly, a primary energy source is continuously operated in continuous operation and the power generated is demanded. The intermittent operation is distinguished in that a ratio of the operating period in working operation to an operating period in no-load operation is at most 30%, at least one crane component, in particular at least one travelling drive motor and/or at least one winch motor being activated in the working operation of the crane and the at least one crane component being deactivated in the no-load operation of the crane. The primary energy source is primarily operated in no-load, as the crane provides the main functions of the at least one crane component discontinuously and not in continuous operation. That means that during intermittent operation an amount of energy can be required from the crane components, wherein that energy amount exceeds currently generated energy amount. Thus, it is necessary to provide additional, returned secondary energy and further energy that is stored in the energy storage units besides to the primary energy amount provided by the primary energy source. The returned energy and the stored energy are available via the power consumer system.

A known demand of power to the combustion engine can also be used for the maximum load control of the combustion engine such that no additional effort arises for the demand of power. That means that if the demand of power is known, it is possible to drive the respective energy source, i.e., the combustion engine, such that said known demand of power is provided. In particular, said energy source is driven in that only the amount of power, and not more, is provided. Thus, the combustion engine can exactly be driven on such a level that said known demand of power is provided. It is therefore possible to avoid providing energy that is not necessary in a current situation. In order to align the energy produced by the combustion engine with the known demand of power, the latter value can be used for the maximum load control of the combustion engine. Further, since the crane components comprise electrical drives and controls with memory functions, it is possible to pre-determine an expected demand for power by the crane components. Thus, it is possible to limit the demand of the power to a maximum value so that it does not exceed the provided power. For instance, this can be done by the maximum load control limiter. If a lifting operation has to be done, the load control limiter can calculate based on the lifting height and the weight of the load, the demand of energy that has to be provided within a given time limit. As power is defined as the rate of energy per time, it is possible to influence the demand of power by varying the time necessary for applying the demand of energy. That is, the larger the time interval is for applying the demand of energy, the smaller is the demand of power. That means by enlarging the time interval for applying the demand of energy, the demand of power can be reduced and so can be limited to a maximum value. Further, it is possible to avoid overloading the primary energy source, i.e., preferably a diesel engine. A comparable, predicted control of a maximum load of hydraulic driven crane components is not possible. Thus, with conventional hydraulic driven crane components, in cases of overly large demands of power by the crane components, for instance, motor rotation speed of the primary energy source drops down and leads to a reduced velocity of movement of the hydraulic crane components. In contrast, the usage of electrical driven crane components in combination with the above explained control of maximum power, can achieve an overall enhancement of the control characteristics for controlling the maximum load.

During a mooring-operation, the electrical drives of the crane components are operated by control of rotation speed or moment of force. Both operating modes could be realized at the crane. The crane can thus be provided with a means, such as a switch or menu choice, that permits the crane operator to switch between both modes. Thus, it is preferably possible to realize a proportional triggering and accordingly a velocity-parameter for an auxiliary reeve winch. Thus, it is possible to switch to an operation mode that is based on the control of the forces on the crane components. For example, if the reeve winch applies constant force, a corresponding reaction force is exerted on a further winch or on another crane component. Thus, the variability of the use of the reeve winch is enhanced by an adequate control and is further adaptable to different operation conditions.

In a method according to one embodiment, the energy usage fraction is either provided for the energy demand by conversion into electric, hydraulic or mechanical energy of the at least one crane component or is fed into the power consumer system. Specifically, the energy usage fraction is provided by feeding into the power consumer system or by means of at least one energy converter connected to the at least one crane component to convert energy from the at least one crane component into power. A method of this type has improved efficiency. The energy is, in particular, provided in the form of electric energy, locally at various points of the crane and can be demanded correspondingly locally without transmission losses directly at the energy source, in particular at the secondary energy source providing the recovered secondary energy. The control of the energy demand either by the power consumer system or directly at the crane component can take place by means of a control unit.

In a method according to one embodiment, it is ensured that an adequate energy usage fraction is always provided during crane operation either by the energy storage unit or the energy sources. Specifically the method comprises controlling a ratio of the energy usage fraction to the energy storage fraction by means of the control unit.

A method according to one embodiment allows an excess energy fraction to be detected, which is provided when a sum of a maximally usable energy usage fraction and a maximally usable energy storage fraction is equal to a sum of the excess energy fraction and the total energy amount. That means that the energy amount generated by the primary energy source and/or secondary energy source is greater than the actual current energy requirement and storable energy fraction.

It is possible by means of a method according to one embodiment, to reduce the excess energy fraction in a controlled manner and to convert it, for example, by means of additional brake resistances into thermal energy. Specifically, the method further comprises controlling reduction of the excess energy fraction by converting energy obtained from additional brake resistances into thermal energy, a return of the thermal energy to the crane being used to heat the crane cabin. This thermal energy may, for example, be returned to the crane and in particular used to heat the crane cabin and may also be used by hydraulic systems. As a result, an additional, separate heating source for the crane cabin or providing a power source for the hydraulic systems can be avoided.

DETAILED DESCRIPTION

An exemplary embodiment is shown in FIG. 1. Crane 1 is configured as a mobile crane with four wheels 2, it also being possible for the crane 1 to have more wheels 2 or alternatively also crawler travel gear (of the type illustrated, e.g., FIGS. 2 and 3). It is understood that any type of travelling gear can be used within the skill of the ordinarily skilled artisan. The crane 1 comprises an undercarriage 3 and a superstructure 5 which is rotatably arranged on the undercarriage 3 by means of a rotary carriage guide 4. A driving cabin 7 with a driving cabin air-conditioning system (DCAC) 8 arranged therein is provided at a front end in the travel direction 6 of the undercarriage 3. Rigidly connected to the superstructure 5 is a crane cabin 9, which has a crane cabin air-conditioning system (CCAC) 10. A crane boom 11 is articulated in a lifting manner on the superstructure 5.

According to the embodiment shown, a primary energy source (PES) 12 is accommodated in the undercarriage 3 of the crane 1. The primary energy source 12 is configured as a diesel engine and drives the wheels by means of a gear 13, although any suitable engine can be used within the skill of the ordinarily skilled artisan. The gear 13 is connected by a clutch, not shown, to the diesel engine 12 in a manner known per se. The diesel engine 12 is cooled by means of a radiator (RAD) 14. Also directly connected to the diesel engine 12 is at least one hydraulic pump 15, which is in signal connection by means of a hydraulic control line 16 with an undercarriage control block (UCB) 17 arranged in the undercarriage 3 and with a superstructure control block (SCB) 18 arranged in the superstructure 5. For this purpose, the hydraulic control line is guided from the undercarriage 3 into the superstructure 5 by way of the rotary carriage guide 4, so the signal connection between the hydraulic pump 15 and the superstructure control block 18 is not impaired by a rotation of the superstructure 5 on the undercarriage 3.

In addition, a control unit 120, is provided, which is connected to the primary energy source 12 and arranged adjacent thereto. The control unit 120 is activated by an operator in the crane cabin 9. It is also possible for the control unit 120 to be operated from the driving cabin 7. The control unit 120 (and the other control units provided in the various embodiments disclosed herein), may be implemented as processors configured to control the various crane components on the crane. Such processors are known in the art. The present invention contemplates providing software stored on a non-transitory computer readable medium to be executed by the processor to perform the various functions discussed in this application.

The control unit 120 may have a start-stop function, by means of which the primary energy source 12 is automatically activated as soon as the start condition is fulfilled and deactivated as soon as the stop condition is fulfilled.

Also connected to the primary energy source 12 is a driving cabin air-conditioning compressor (DCACC) 19 to operate the driving cabin air-conditioning system 8. For this purpose, the driving cabin air-conditioning compressor 19 is in signal connection with the driving cabin air-conditioning system 8 by means of the driving cabin air-conditioning line 20.

Furthermore, the primary energy source 12 drives a primary energy source generator (PESG) 21, which is connected to a battery 23 by a power line 22 (i.e., a power consumer system) to charge the battery 23. At least one electric consumer (EC) 24 is connected to the primary energy source generator 21 and, according to the embodiment shown, is arranged in the superstructure 5. A plurality of electric consumers may also be provided, which are arranged in the undercarriage 3 and/or in the superstructure 5 of the crane 1. Lights for the cabins 7, 9, a light for the surroundings of the crane, warning lights and warning signals, a crane control with a display, a radio or further auxiliary energy consumers, such as radio apparatuses, mobile radio charging apparatuses etc., are non-limiting examples of such electric consumers 24. The power line 22 is also guided by way of the rotary carriage guide 4 to connect the primary energy source generator 21 to the at least one electric consumer 24 arranged in the superstructure 5.

In this embodiment, a secondary energy source (SES) 25 is provided in the superstructure 5, which may be configured as an internal combustion engine, e.g., a diesel engine. The secondary energy source 25 may be any suitable engine. The secondary energy source 25 is cooled by a secondary energy source radiator (SESR) 26, which is in cooling connection by a cooling line 27 by way of the rotary carriage guide 4, with the radiator 14 arranged in the undercarriage 3. It is therefore possible for the primary energy source 12 to be temperature-controlled by the secondary energy source 25 by means of the radiator 14 and/or the secondary energy source radiator 26 and the cooling line 27. From the secondary energy source 25, heated cooling water may, for example, be conveyed from the secondary energy source radiator 26 via the cooling line 27 into the radiator 14 and the primary energy source 12 thus pre-heated, so that a cold start can be avoided. The secondary energy source 25 drives an auxiliary source generator (ASG) 28, which also feeds the battery 23 and the at least one electric consumer 24 via the power line 22. A crane cabin air-conditioning compressor (CCACC) 29, which is connected by a crane cabin air-conditioning line 30 to the crane cabin air-conditioning system 10, is directly connected to the secondary energy source 25.

The secondary energy source 25 may be smaller and less powerful than the primary energy source 12, a maximally available power $PS_{max}$ of the secondary energy source 25 being smaller than a maximally available power $PP_{max}$ of the primary energy source 12. For example, $PS_{max} \leq 0.5 \cdot PP_{max}$, in particular $PS_{max} \leq 0.3 \cdot PP_{max}$ and, in particular $PS_{max} \leq 0.1 \cdot PP_{max}$. Thus, it is possible to use a small engine as secondary energy source 25, since the maximally available power $PS_{max}$ is small. As a consequence, energy consumption, and also emissions, caused by the primary energy source 12 and the secondary energy source 25 are reduced. Also necessary space for the secondary energy source 25 on the crane is used.

The secondary energy source 25 may be retrofitted, so the secondary energy source 25 can be fastened by means of a correspondingly configured adaptor receiver (not shown) on the crane 1. The secondary energy source 25 is also called an additional assembly. One or more of the crane components, such as, for example, a luffing mechanism, and a cable winch or, for example, a rotary mechanism to actuate the crane boom 11, may also be used as the secondary energy source 25.

The function of the crane 1 will be described in more detail below. In working operation, the primary energy source 12 drives the travelling drive, i.e., the wheels 2 of the crane 1 by means of the gear 13. Furthermore, the hydraulic pump 15, which supplies the undercarriage control block 17 with compressed oil, is driven by the primary energy source 12. During road travel, the superstructure 5 does not perform any operations or functions, so that the secondary energy source 25 can be deactivated.

As soon as, during working operation, the lifting device of the crane 1 is operated, hydraulic oil is conveyed by the hydraulic pump 15 via the hydraulic control line 16 by way of the rotary carriage guide 4 into the superstructure control block 18. The lifting device is comprised of the superstructure 5 and crane boom 11. The superstructure control block 18, in conjunction with an electronics system, not shown, in a manner known per se, controls various crane movements, such as, for example, the rotation of the superstructure 5 on the undercarriage 3 or a pivoting of the crane boom 11 relative to the superstructure 5. In addition, the primary energy source 12 drives the primary energy source generator 21, which charges the battery 23 and supplies the at least one electric consumer 24 with electric voltage.

As mentioned above, during the working operation of the crane 1, a stop phase may occur, during which no crane power is required, i.e., neither the superstructure 5, the boom 11 nor the travelling drive (wheels 2, and gear 13) of the crane 1, are actuated. This stop phase is recognised by means of the start-stop function of the control unit with the aid of the stop condition, so that, on the occurrence of one of the stop conditions listed below by way of example, the primary energy source 12 is deactivated.

Possible stop conditions are, for example, 1) no demand for hydraulic power, i.e. to drive activation of the superstructure 5, lifting device 11 or the travelling drive (wheels 2, gear 13), 2) detection of the presence of a battery voltage within predetermined limits via a battery voltage level detector 112, 3) presence of a cooling water temperature of the primary energy source 12 within limit values using a cooling water temperature detector 113, 4) temperature of the pressure oil within limit values via a pressure oil temperature detector 114, and 5) when only auxiliary components connected to receive energy solely from the secondary energy source are turned on, and 6) further stop conditions, which may be individually specified by a user. Said limit values for the cooling water temperature are between 70 to 95° C., in particular 75 to 93° C., and in particular 80 to 92° C. The limit values for the pressure oil temperature depend on the type of pressure oil used. For instance, said limit values are between 40 and 80° C., and in particular 55° C. However, a load moment of the crane is detected. That detected load moment has to be smaller than a defined load moment threshold value, which is, for instance 30% related to a maximum available load moment of the crane. The load moment is monitored intermittently, regularly or continuously at a load moment indicator (LMI), not shown in FIG. 1 but further described below. If the current load moment exceeds the load moment threshold value, the crane driver must be enabled to react promptly in any case of crane operation for safety reasons. Therefore, the stop conditions are enabled, if the load moment exceeds the load moment threshold value.

During a stop phase of the primary energy source, a series of functions may be required to be performed which require the operation of auxiliary components of the crane 1. Therefore, during the stop phase, the following functions and/or auxiliary components are provided power by the secondary energy source 25, such as, for example, air-conditioning systems 8, 10, cabin heating or heated engine cooling water and blowers (not shown), temperature-control of the primary energy source 12, for example by means of cooling water of the secondary energy source radiator 26 to avoid a cold start, current generation for electric consumers such as light in the cabins 7, 9, light of the surroundings of the crane, warning lights and warning signals, crane control with display, radio, auxiliary consumers such as radio apparatuses, mobile radio charging apparatuses, fans, oil coolers, oil circulation for cooling and filtering and maintaining the battery charge as well as further functions and/or auxiliary components which may be provided in accordance with normal crane operations.

In addition, the secondary energy source 25 may drive further hydraulic pumps, not shown, which allow an activation of the lifting device (superstructure 5 and/or boom 11) and/or cable winches or cylinders (not shown). Consequently, emergency operation may be provided by the secondary energy source 25 in the event of a temporary complete (or partial) failure of the primary energy source 12. Regular crane movement can therefore be provided by the secondary energy source 25, without the powerful primary energy source 12 having to be started. Therefore, depending on a maximum available power of the secondary energy source 25, said energy source 25 may be used as an additional drive, without the primary energy source 12 having to be started. As already described above, it is of course also possible to build the secondary energy source 25 as a small-capacity energy source that provides only a small amount of maximum available power. In that case, the secondary energy source 25 is not able to drive regular crane movement, but due to the small size of the secondary energy source 25, it is space and cost saving and further produces less emissions.

Due to the realisation of the start-stop function of the primary energy source 12 and the independent arrangement of the secondary energy source 25 from the primary energy source 12, as described above, standstill phases of the primary energy source 12 can be extended and thereby the fuel consumption reduced, the pollutant emission, in particular the $CO_2$ emission reduced, noise pollution reduced, wear of the corresponding components of the crane 1 reduced and maintenance intervals for the primary energy source 12 extended. The total weight of the crane 1 may also be reduced compared to a crane known according to the prior art with a powerful, separate superstructure motor to drive the crane hydraulics.

It is also possible, to arrange the secondary energy source 25 in the undercarriage 3 of the crane 1. Accordingly, the secondary energy source radiator 26, the secondary energy source generator 28 and the crane cabin air-conditioning compressor 29 would also be provided in the undercarriage 3. With regard to the function of the crane 1, reference is made to the aforementioned configurations. In a crane 1 of this type, the centre of gravity is preferably displaced downward. Thus, the stability moment of the crane 1 is additionally increased.

It is also possible to arrange the primary energy source 12 together with the secondary energy source 25 in the superstructure 5 of the crane 1 or to arrange the primary energy source 12 in the superstructure 5 and the secondary energy source 25 in the undercarriage 3 of the crane 1.

Figure 2:
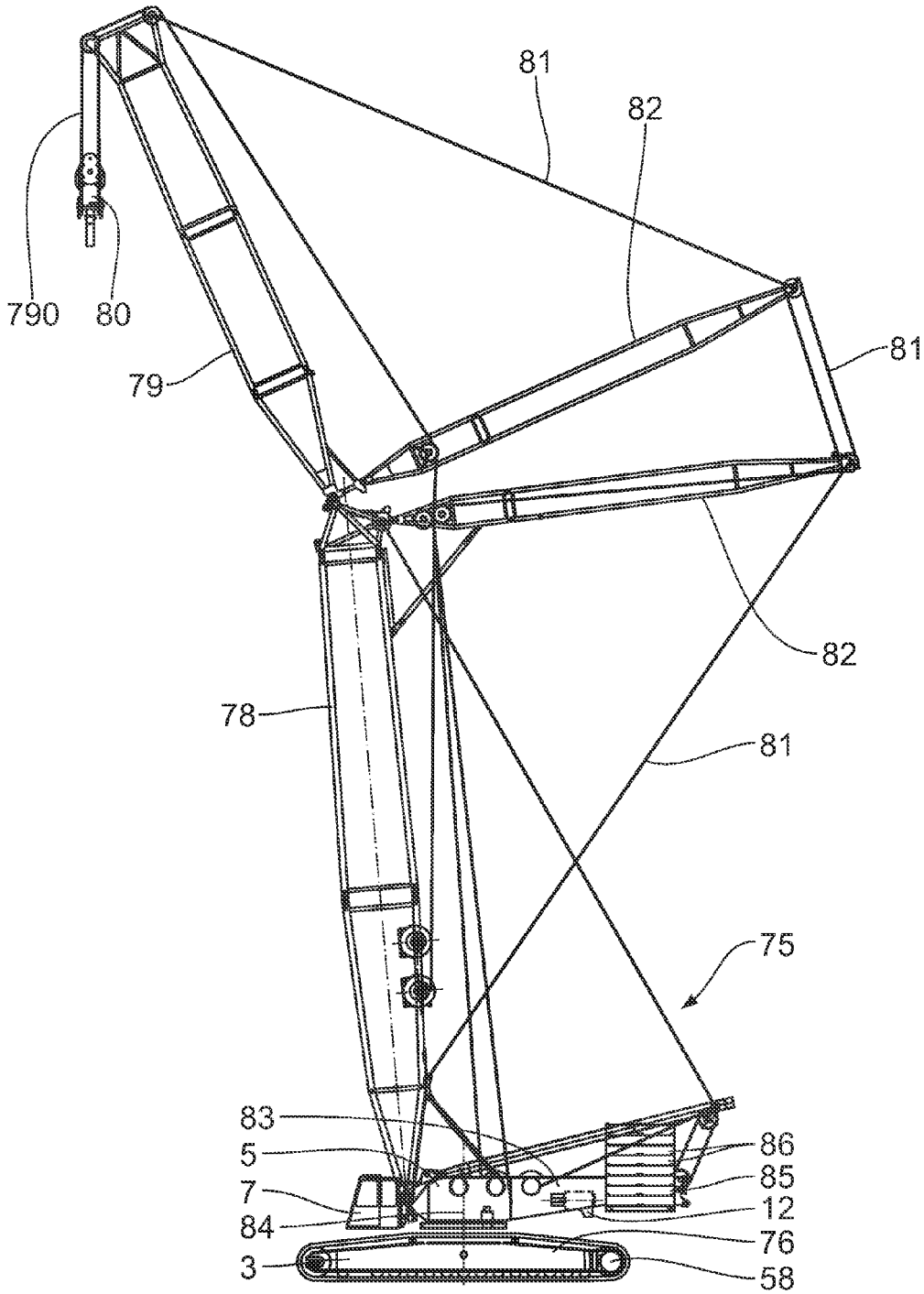
FIG. 2 shows a side view of a crawler crane according to a second embodiment with a plurality of crane components configured as secondary energy sources to recover energy.
Figure 3:
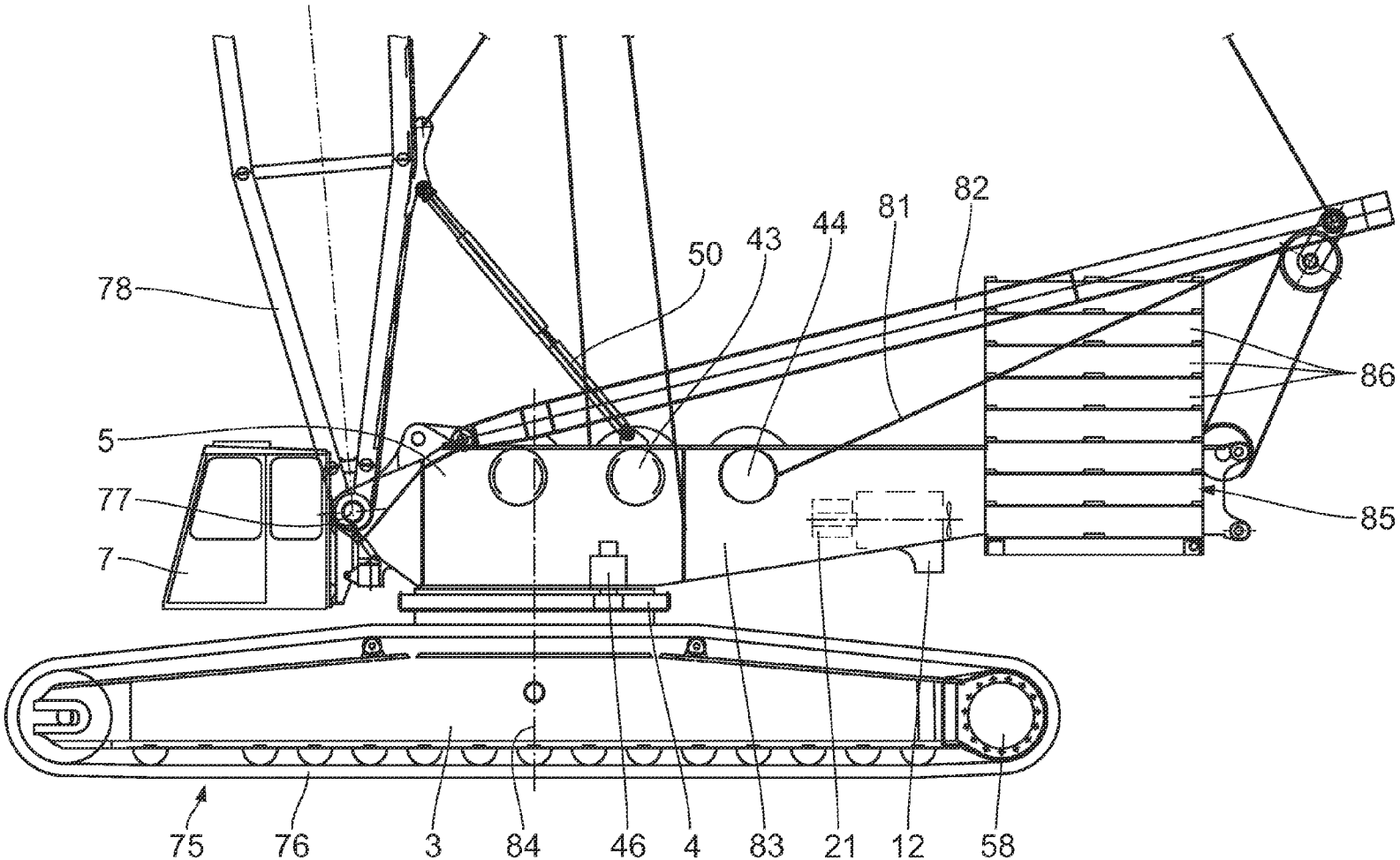
FIG. 3 shows an enlarged detail view according to FIG. 2.

FIGS. 2 and 3 show an exemplary embodiment of a further configuration of a crane 75. Components, which correspond to those, which have already been described above with reference to FIG. 1 have the same reference numerals and will not be described again in detail.

The crane 75 in this exemplary embodiment is configured as a crawler crane with two crawler travel gears 76 arranged in parallel on the undercarriage 3. Alternative arrangements of the crawlers or other drive means may be used. The superstructure 5, which comprises the driving cabin 7 and a main boom 78 which can be pivoted about a horizontal axis 77 (see FIG. 3), is rotatably arranged on the undercarriage 3. At an end of the main boom 78 opposing the horizontal axis 77, the latter is also pivotably connected to an auxiliary boom 79. A pulley 80 with a hook for lifting and displacing loads is provided at the tip of the auxiliary boom 79. The lifting cable 790 connects the auxiliary boom 79 to the pulley 80. The main boom 78 and the auxiliary boom 79 are braced by a tensioning system comprising, for example, a plurality of tensioning cables 81 and supports 82.

In the embodiment of FIGS. 2 and 3, counter-weight arrangement 85 is provided on a cross member 83 extending substantially horizontally of the superstructure 5, spaced apart from a vertical rotational axis 84, about which the superstructure 5 is rotatably mounted with respect to the undercarriage 3. The counter-weight arrangement 85 comprises a plurality of counter-weights 86 placed on top of one another. However, the counter-weight arrangement 85 may have two stacks (not shown) of individual counter-weights 86 arranged laterally in each case on the cross member 83. Other arrangements for the counterweights may also be used, within the skill of the ordinarily skilled artisan.

Also attached to the cross member 83 is the primary energy source which may be in the form of a diesel engine 12 (or other suitable engine) and a primary energy source generator 21 connected thereto. A pivoting mechanism 46 is provided on the rotary carriage guide 4 connecting the undercarriage 3 to the superstructure 5, to pivot the superstructure 5 about the rotational axis 84. Each of the crawler travel gears 76 of the undercarriage 5 is configured and oriented symmetrically with respect to the rotational axis 84 and has a travelling drive 58.

Also provided rotatably about a horizontal axis on the cross member 83 is a cable winch 43, which is connected by a cable to one of the supports 82. A telescopic cylinder 50 connects the main boom 78 with the cross member 83. By actuating the telescopic cylinder 50 it is retracted or extended, thus effecting a pivoting movement of the main boom 78 about the horizontal axis 77. The telescopic cylinder 50 may be a hydraulic piston, or similar mechanism.

Moreover, a luffing mechanism 44 is provided on the cross member 83 and is connected by a tensioning cable 81 and supports 82 to the auxiliary boom 79. The luffing mechanism 44 is correspondingly used to pivot the auxiliary boom 79 relative to the main boom 78.

The start-stop functions described above with respect to FIG. 1 also may be implemented in the crane 75 of the second embodiment. The operation of the start-stop functions would be the same compared to the first embodiment shown in FIG. 1, so that detailed description thereof will be omitted.

Figure 4:
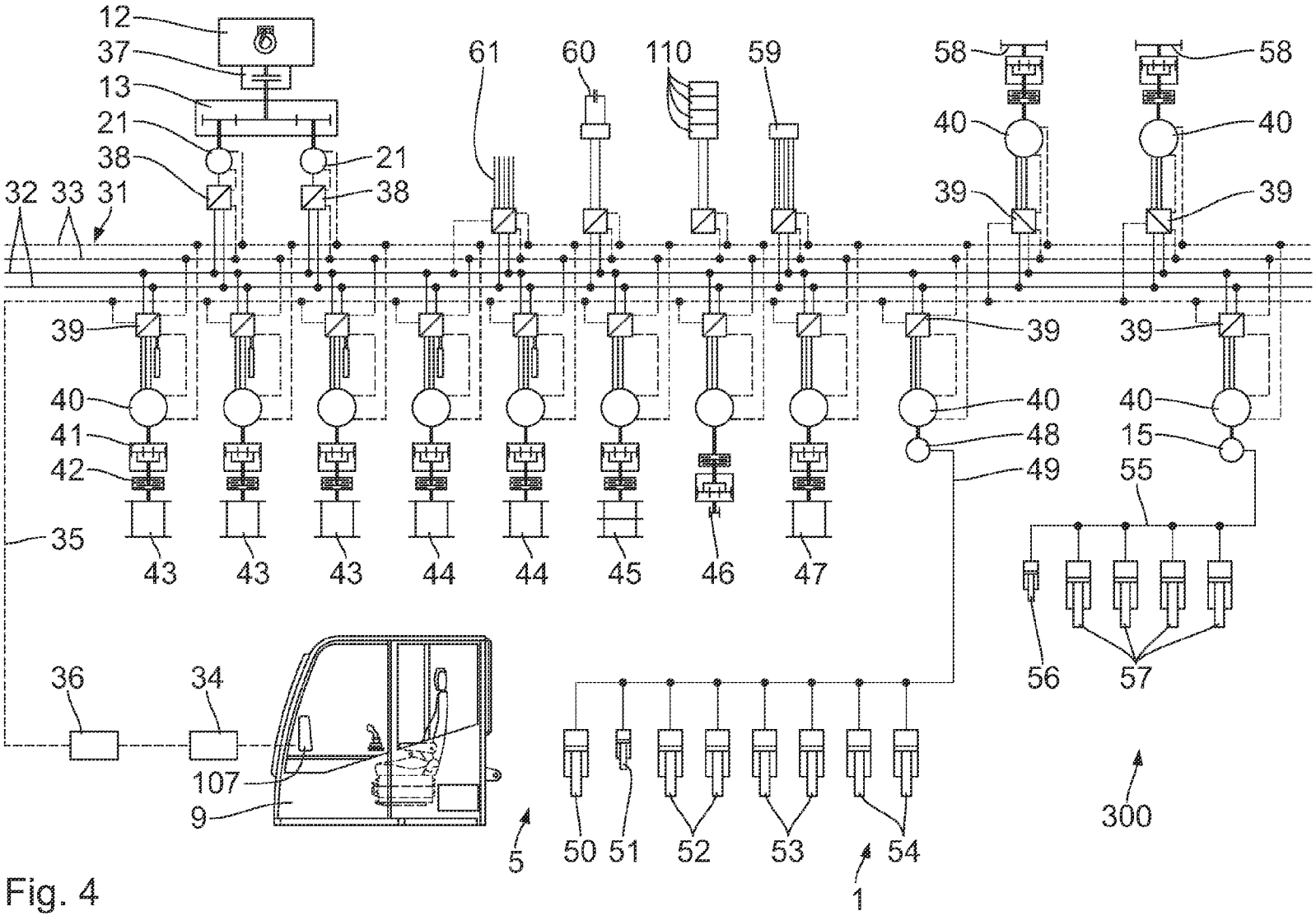
FIG. 4 shows a schematic view of a diagram for an energy supply of the crane according to FIG. 2.

FIG. 4 shows an exemplary embodiment of a schematic view of an electric circuit 300 of the crane 75. The power consumer system 31 comprises two power lines 32, of which one is used as the positive pole and the other is used as the negative pole. A voltage of 650 V is applied to the power consumer system 31. Cooling water hoses 33 are also provided as central supply lines and are used as the feed and return line for cooling water. The power lines 32 are connected to various components as will be explained below, to supply power for operation of those components.

To control the power consumer system 31, a control unit (CU) 34 is connected via a data bus 35, which is, in this embodiment, designed as a CAN bus line, but can be any suitable line as would be understood by one of ordinary skill in the art. The control unit 34 is connected via an interface (IF) 36 to the data bus 35 in the embodiment shown. Therefore, the control unit 34 is connected to the power consumer system 31 via the data bus 35 and therefore the control unit 34 is further connected to all components directly and indirectly connected to the power consumer system 31.

To feed primary energy into the power consumer system, the primary energy source 12, which may be provided in the form of the diesel engine, is connected by means of a clutch 37 to the gear 13, by means of which two primary energy source generators 21 are driven. In the generators 21, the mechanical energy is converted into electric energy and fed via the rectifiers 38 into the power consumer system 31. Both the rectifiers 38 and the primary energy source generators 21 are, on the one hand, connected to the cooling water lines 33 and, on the other hand, to one another and are therefore connected to the cooling water supply of the crane 1.

The power consumer system 31 is activated by means of the control unit 34 by an operator in the crane cabin 9. It is also possible for the control unit 34, additionally or alternatively, to be operated from the driving cabin 7, so a control of the power consumer system 31 is also ensured from the driving cabin 7. Proceeding from the power consumer system 31, a large number of crane components (electric consumers) can be supplied with energy, with it basically being possible to distinguish between two different drive types, rotary and linear drives.

The crane components driven by rotary drives, such as the cable winches 43, luffing mechanisms 44, derricking gears 45, a pivoting mechanism 46, and a shear winch 47, are connected by a converter 39 to the power consumer system 31 and the converter 39 supplies electric motors 40 with electric energy. The electric motors 40 drive consumer gears 41, which are connected by brakes 42 to the respective actual crane components 43-47. According to the embodiment shown, three cable winches 43, two luffing mechanisms 44, one derricking gears 45, one pivoting mechanism 46 and one shear winch 47 are provided as crane components connected to brakes 42. Other crane components may be connected as well, or fewer brake components may be connected, as would be understood by one of ordinary skill in the art.

The crane components driven by linear drives, such as those driven by hydraulic cylinders, are provided in such a way that an electric motor 40 is also supplied with energy by the power consumer system 31 by means of a converter 39. The electric motor 40 feeds a hydraulic pump 48. The hydraulic pump 48 is used as an energy converter to convert the electric energy into hydraulic energy. Crane components in the form of hydraulic cylinders may also be connected by a hydraulic distributor line 49. A telescopic cylinder 50 is used to retract and extend the telescopic main boom 78. Cabin cylinders 51 are used to incline the driving cabin 7 and/or the crane cabin 9. Securing cylinders 52 are provided to secure the crane boom 11 or 78 and further securing cylinders 53 are provided to secure the superlift masts. The cylinders 54 are provided to displace the superstructure of the crane. The cylinders 50 to 54 are also used to supply the electric consumers 25 with power, which are arranged on the superstructure 5. It is also possible to use an electric linear drive additionally or instead of the hydraulic cylinders.

The hydraulic pump 15 in the undercarriage 3 (shown in the embodiment of FIG. 1, but also present in the embodiment of FIGS. 2-3) is also connected in an analogous manner by a converter 39 and an electric motor 40 to the power consumer system 31 in order to convert the electric energy supplied from the power consumer system 31 into hydraulic energy and to feed it into the hydraulic distributor line 55. Provided on the hydraulic distributor line 55 of the hydraulic pump 15 are a rapid connection cylinder 56 and four support cylinders 57 to support the undercarriage 3 or to increase the height of, or to level, the support base (not shown in the drawings) for the crane 1. The support base of the crane comprises several outriggers connected to the undercarriage drive of the crane 1, 75. Each outrigger is supported on the ground by at least one hydraulic cylinder that is attached to a second end of the outrigger opposing to a first end of the outrigger connected to the undercarriage 3. The hydraulic pump 15 enables storing of a hydraulic liquid, e.g., oil, and therefore, the hydraulic pump may be used as a secondary storage unit.

Also connected to the power consumer system 31 are travelling drives 58 in an embodiment in which the crane 75 is equipped with crawler travel gear 76 (as shown in the embodiment of FIGS. 2 and 3) instead of wheels 2 (FIG. 1 embodiment). It is possible to use peripheral drives, one for each of the wheels 2 to have a multiple drive. In that case, it is also possible to individually drive, to brake and/or to control, i.e., to steer, the wheels. Alternatively, it is also possible to provide a central steering unit, a central brake system and further a central drive so that some or all of the wheels 2 are simultaneously driven and/or steered. It is also possible to create a hybrid design, in which some of the wheels 2 are individually operated and a group of other wheels 2 is simultaneously operated by central drive, brake and steering systems. In this case, one of the travelling drives 58 is provided in each case for the left-hand and the right-hand travel gear 76 (only one of which is shown). Other configurations are also possible as would be understood by one of ordinary skill in the art.

The rotary devices shown schematically in FIG. 4, such as cable winches 43, luffing mechanisms 44, derricking gears 45, a pivoting mechanism 46 and a shear winch 47, may be used as secondary energy sources. In that case, for example, potential energy is converted into kinetic energy from the cable winches 43 by means of a lowering of the load. By turning consumer gears 41 connected to the rotary devices, for example, winches 43, the rotary movement of the respective gear 41 is transmitted to the respective electric motor 40, which acts as a generator and converts the rotary movement into electric energy and feeds the latter via the converter 39 into the power consumer system 31. Reeving of the lifting cable 790 in the pulley 80, even small movements, i.e., only a short lowering of the load, cause a relatively high number of winch revolutions. As a result, high generator speeds are possible, so that a high degree of efficiency in energy conversion may be achieved.

Apart from the primary energy source 12 and the secondary energy sources 43 to 47, the possibility is provided of an external energy supply 59, which, for example, allows a feeding of energy directly into the power consumer system 31. Therefore, in addition, or alternatively to the primary energy source 12 and the secondary energy sources 43 to 47, electric energy can be used that is obtained directly from a mains supply. It is thereby possible to operate the crane 1 independently of an internal combustion engine, which, for example, is deactivated in the presence of a stop condition.

Figure 5:
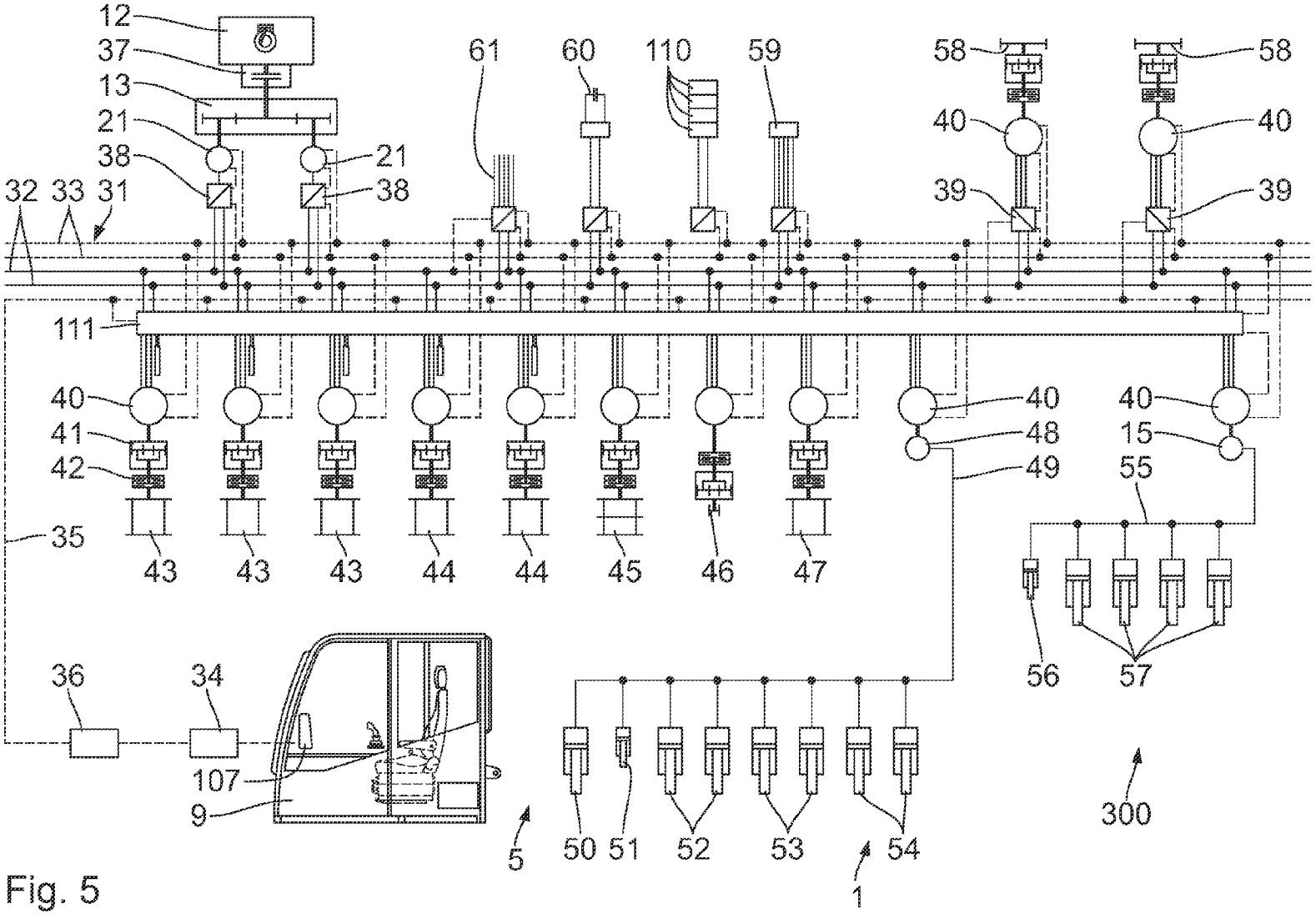
FIG. 5 shows a schematic view according to FIG. 4 of a further embodiment of a crane.

The plan shown in FIG. 4 of the energy supply of the crane 1, 75 is called a local system, since the individual consumers, i.e., the crane components, are in each case separately connected by the converter 39, electric motor 40, consumer gear 41, brake 42 and corresponding rotary devices 43 to 47 to the power consumer system 31. A central system for the energy supply is also possible as an alternative or supplement, in which a central switch-over unit is provided, to which the rotary devices can be connected. The central switch-over unit 111 is shown in FIG. 5. Said central switch-over unit 111 converts the rotary movement of the rotary device(s) to electric energy to be supplied as secondary energy to the power consumer system 31. The advantage in the central solution is the reduction in the number of required converters 39. Since the local model manages without a central switch-over unit 111, however, the local system is, as a whole lighter in weight and more cost-effective, as, in particular, the costs for a switch-over unit 111 are higher than costs for additionally required converters.

A further advantage of the local system is the integrated control in the crane components. Since high, pulsed currents are fed on the shortest paths, i.e., without an interposed switch-over unit, into the respective electric motor 40 by the power consumer system 31, energy losses are reduced and therefore the efficiency of the energy supply improved. Overall, only two power lines 32 are required in the crane 1, 75, which distribute the power in the form of electric energy to the crane components. The rotary guide 4 between the undercarriage 3 and the superstructure 5, because of the reduced required number of lines, may be configured to be smaller and therefore more economical and stable. In particular, the rotary guide 4 in the local system is less prone to malfunction. Because of the reduced number of required power lines 32, the required number of connecting plugs to connect the lines 32 is also reduced. This is realised for both the first and the second embodiment of this invention.

Figure 6:
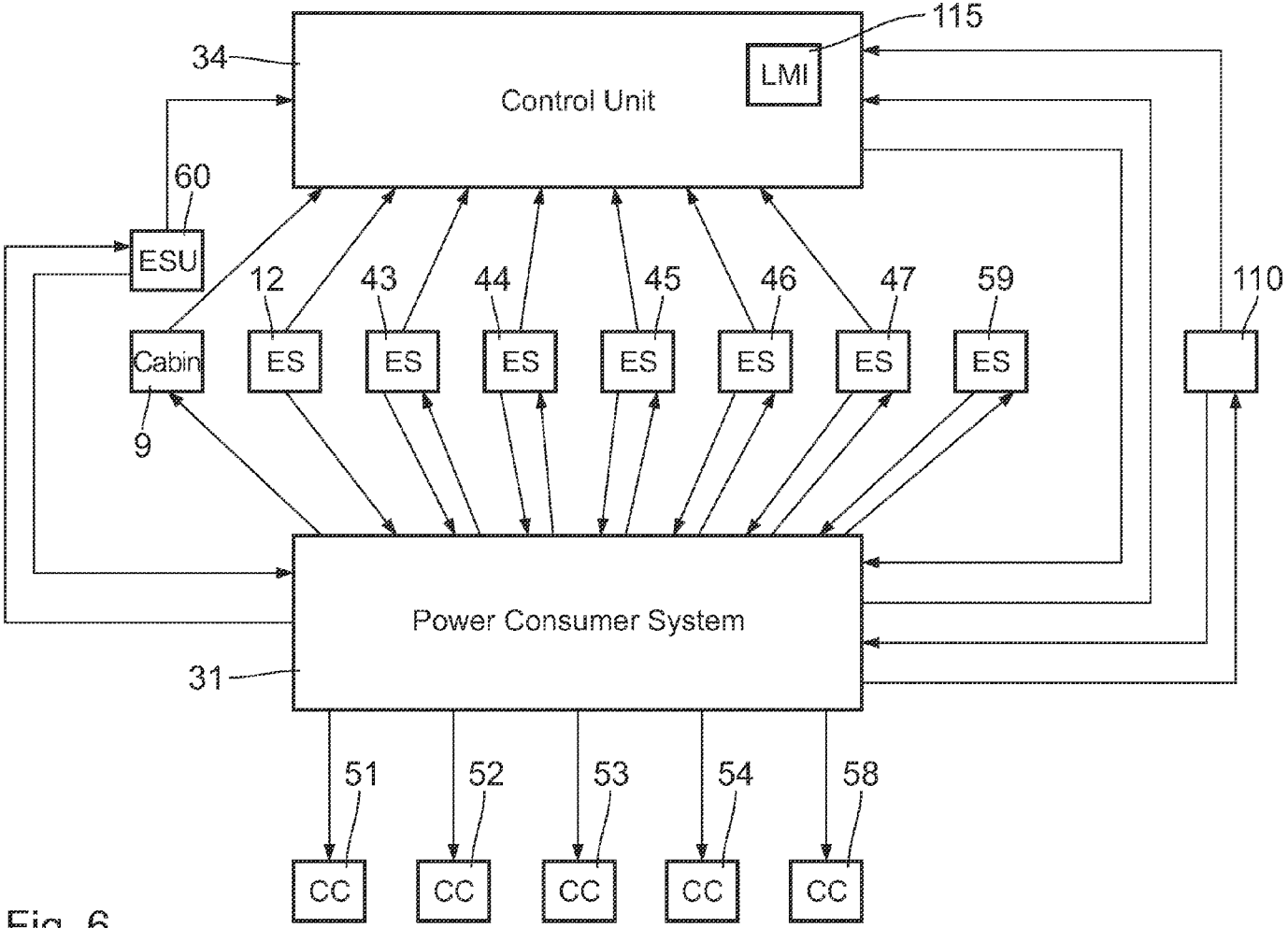
FIG. 6 shows a schematic view of a control cycle with corresponding assemblies according to FIGS. 2 to 4.

Furthermore, in both embodiments an energy storage unit 60 is connected to the power consumer system 31 (see FIG. 6). The energy storage unit 60 is, in this case, provided centrally on the crane as a main energy store and is configured, for example, as a battery pack. This battery pack may alternatively be arranged as part of the stackable counterweight on the crane 1, 75 as a base ballast or as a superlift counterweight on a separate counterweight carriage. At least one fuel cell 110 is connected to the power consumer system (see FIGS. 4, 6). The fuel cells 110 provide energy for the power consumer system 31 if it is demanded.

Moreover, a plurality of local energy storage units may be provided on the crane 1, 75, which are connected to the power consumer system 31 and are used to store primary energy and/or secondary energy. For instance, a winch having a local energy storage unit operatively connected thereto may be provided. The energy storage units may be in one embodiment, directly associated with the crane components in order to reduce transmission losses and therefore improve the efficiency of the system.

The on-board electrical system 61 is also connected to the power consumer system 31. The electrical system 61 is a power outlet that ranges from 12 V to 400 V. That power outlet can be utilized, e.g., for cabin heating, hydraulic heating, radio, etc. Thus the power outlet may be interpreted as an auxiliary outlet. Alternatively, the auxiliary components as discussed above, which, for instance, may be battery packs and/or fuel cells, are not intended to be auxiliary but base configuration of supplemental power supplies.

Figure 7:
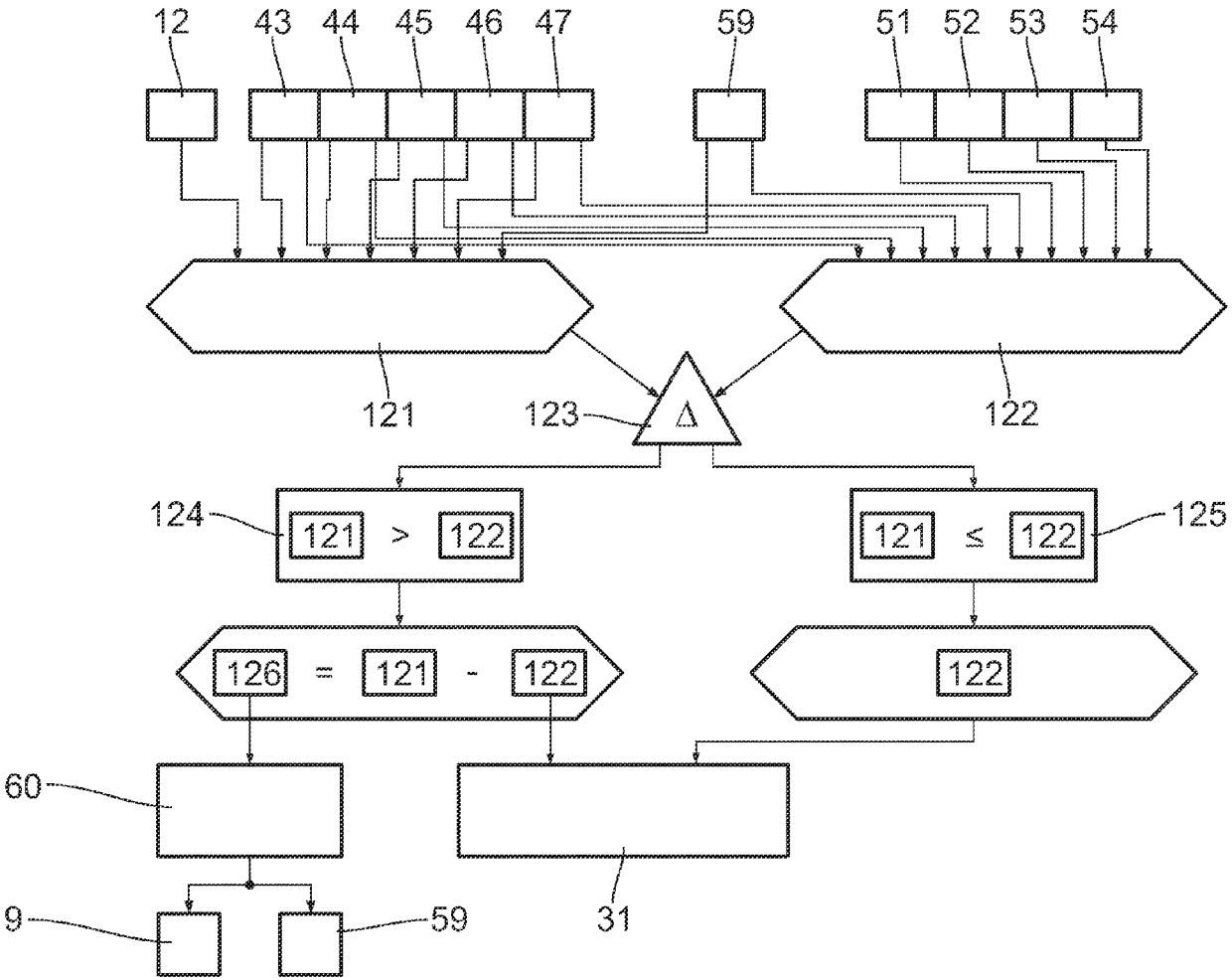
FIG. 7 shows a flow-chart for operating a energy management system of a crane according to the invention.
Figure 8:
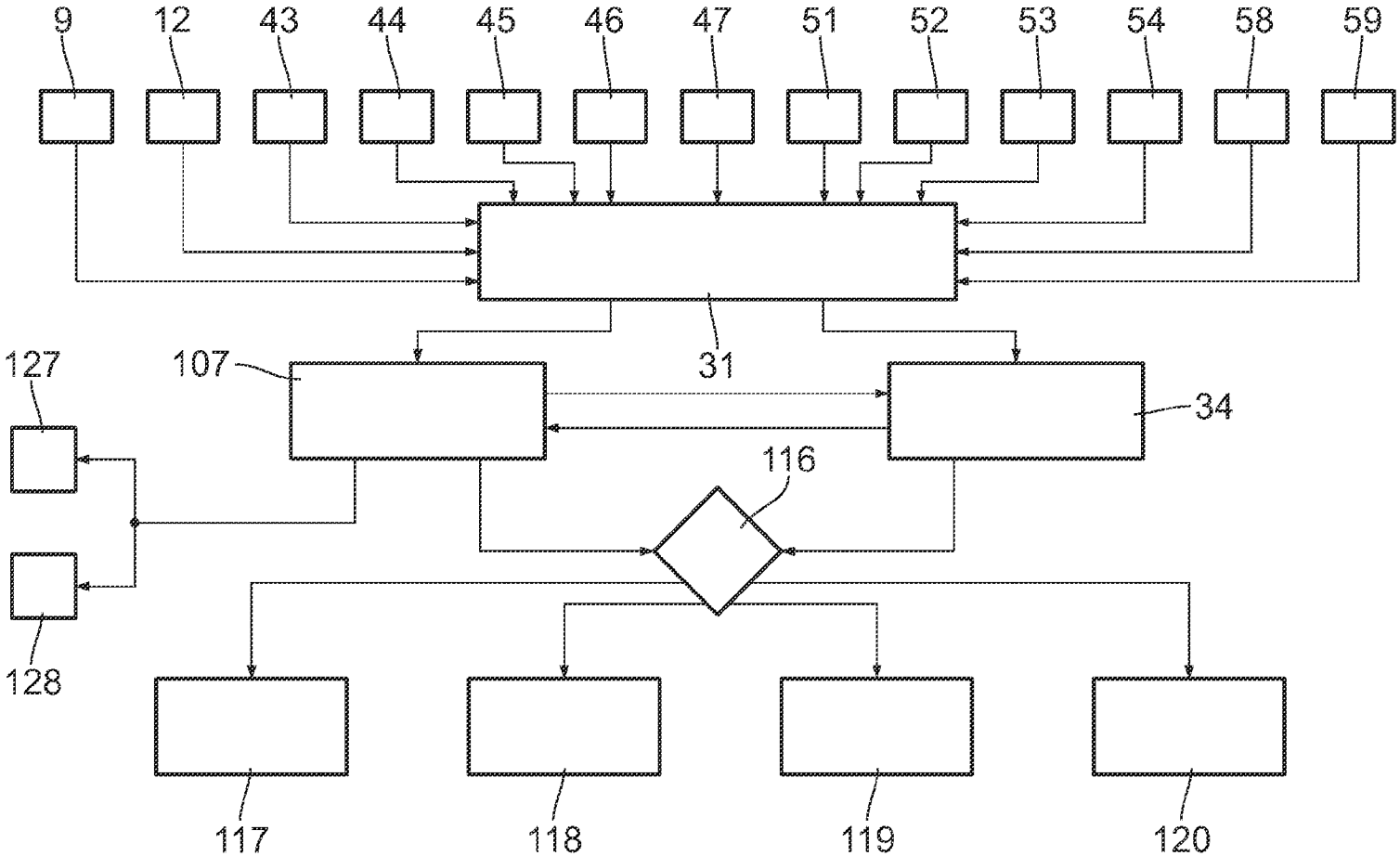
FIG. 8 shows a flow-chart for selecting an operation mode of a crane according to the invention.

FIG. 6 shows a schematic cycle for controlling the energy of the crane 75. Further, FIG. 7 illustrates a flow-chart of determination of various energy amounts in the crane system. A similar schematic can be shown for the crane 1 shown in the embodiment of FIG. 1 or the crane 87 shown in the embodiment of FIGS. 2 and 3. The configuration thereof is within the skill of the ordinarily skilled artisan once the crane components on the crane are identified. The primary energy source (ES) 12 as well as the crane components 43 to 47 also useable as secondary energy sources, and are in signal connection with the power consumer system 31 for feeding in primary and/or secondary energy. Further, the external energy supply 59 may be provided for an alternate feeding-in of external energy. The total energy 121 is sum of the energy amounts fed in by the energy sources 12, 43 to 47 and 59 to the power consumer system 31. A fraction therefrom, referred to as the energy usage fraction 122, is demanded by the crane components 43 to 47, 51 to 54 for operation. For that purpose, the crane components 43 to 47, 51 to 54 are in signal connection with the control unit 34. A load moment indicator 115 (LMI) is integrated in the control unit 34 and enables power management of the cranes 1, 75, and 87. Thus, it is possible for the control unit 34 to determine a current and/or an estimated energy usage fraction 122 for each of the crane components 43 to 47 and 51 to 54, e.g., due to a planned lifting or other operation of the component, by a comparator 123 provided with the control unit 34. As a result of the comparison performed by the comparator 123, it is possible to decide whether a first case 124 in which the total energy amount 121 is larger than the total energy usage fraction 122, or a second case 125 is current, in which the total energy amount 121 is smaller than or equal to the total energy usage fraction 122. The total energy usage fraction 122 of the crane 75 is equal to the sum of all energy usage fractions of the crane components 43 to 47 and 51 to 54 and the energy usage fraction of the travelling drive 58. If the amount of the energy that is fed into the power consumer system 31 exceeds the current energy usage fraction, i.e., if the amount of energy produced exceeds the amount of energy needed by the various components, the surplus amount of energy is transmitted as an energy storage fraction 126 from the power consumer system 31 to the energy storage unit (ESU) 60 and/or to at least one fuel cell 110 (not shown in FIG. 7, see FIG. 6). For that purpose, the power consumer system 31 is in signal connection with the energy storage unit 60 and the at least one fuel cell 110. If the energy storage unit 60 is not able to accept any amount of energy, e.g., if the energy storage unit 60 comprises a battery that is fully loaded, and, an excess amount of energy is provided by the energy sources 12, 43 to 47, the excess amount of energy can be translated, for instance, via electric lines to the external energy supply 59 and/or to the crane 75 itself, for example, as electrical energy for running an electrical heating in the crane cabin 9 or even as thermal energy, i.e., heated air via a heating pipe to the crane cabin 9. The same procedure arises if the at least one fuel cell 110 is fully loaded. The excess amount of energy may also be fed back as electrical energy back to the external energy supply 59.

The control unit 34 enables the monitoring of the separate energy usage fractions of the crane components (CC) 43 to 47 and 58. Further, the control unit 34 enables the monitoring of the energy amounts fed-in to the energy sources (ES) 12, 43 to 47 and 59. In addition, the energy storage fraction in the energy storage unit 60 is also monitored by the control unit 34. With these monitoring functions, the control unit 34 enables an effective, fast and direct energy management of the crane 75. The actuation of the crane components may be done by a crane operator in the crane cabin 9 via the central control unit 34 or the driving cabin 7.

A cable winch 43 will be described in more detail below with the aid of FIG. 9. The cable winch 43 is shown in a longitudinal section parallel to a rotational axis 62. The cable winch 43 is rigidly installed on the crane 1, or crane 75, with a winch holder 63 on the engine side and a winch holder 64 on the gear side. Provided between the winch holders 63, 64 is a sheet metal trough 65, which, on the one hand, is used to stabilise the winch fastening and, on the other hand, can also be used to fasten the winch 43 to the crane 1 or 75.

Arranged concentrically with the rotational axis 62 is the electric motor 40, which may be configured as a torque motor. Other motors may also be used within the skill of the ordinarily skilled artisan. Since the electric motor 40 is integrated in the cable winch 43 in this embodiment, the space requirement on the crane 1 or 75 is reduced. As a result, it is possible to construct the crane 1 or 75 in a smaller overall size. The electric motor 40 is non-rotatably held on the winch holder 63 on the motor-side and rotatably connected by means of a sleeve 66 and a roller bearing 67, which may be configured as floating bearing about the rotational axis 62, to a cable drum 68 of the cable winch 43. The cable drum 68 is also arranged concentrically with respect to the rotational axis 62 and has a hollow and cylindrical shape. The motor 40 is arranged within the cable drum 68 and it therefore is possible to arrange it in a particularly space-saving manner on the crane 1 or 75.

According to one embodiment, the cable drum 68 has an internal diameter Di of approximately 540 mm, and therefore can provide sufficient space for a conventional commercial torque motor. Provided on an outer lateral surface of the cable drum 68 are guide grooves 69 on which the cable is to be wound. Arranged on end faces of the cable drum 68 are plates 70, which extend away, in each case, substantially radially from the cable drum 68 and are used to guide and hold the wound-on cable.

The motor 40 also has a continuous drive shaft 71, which is arranged concentrically with respect to the rotational axis 62. The drive shaft 71 is non-rotatably connected to the motor 40 and mounted guided in a fixed planetary gear 73, which acts as a fixed bearing. The drive shaft 71 transmits a drive torque to a circulating gear housing 72 and drives the latter. The gear housing 72 is non-rotatably connected to the cable drum 68 and therefore ensures a torque transmission from the motor 40 via the drive shaft 71 and the fixed planetary gear 73 to the cable drum 68.

The brake 42, which is stationarily fastened to the adaptor flange 74, is provided on the winch holder 64 on the gear side by means of an adaptor flange 74. The brake 42 may be configured as an electromagnetic spring pressure multiple disk brake.

Figure 9:
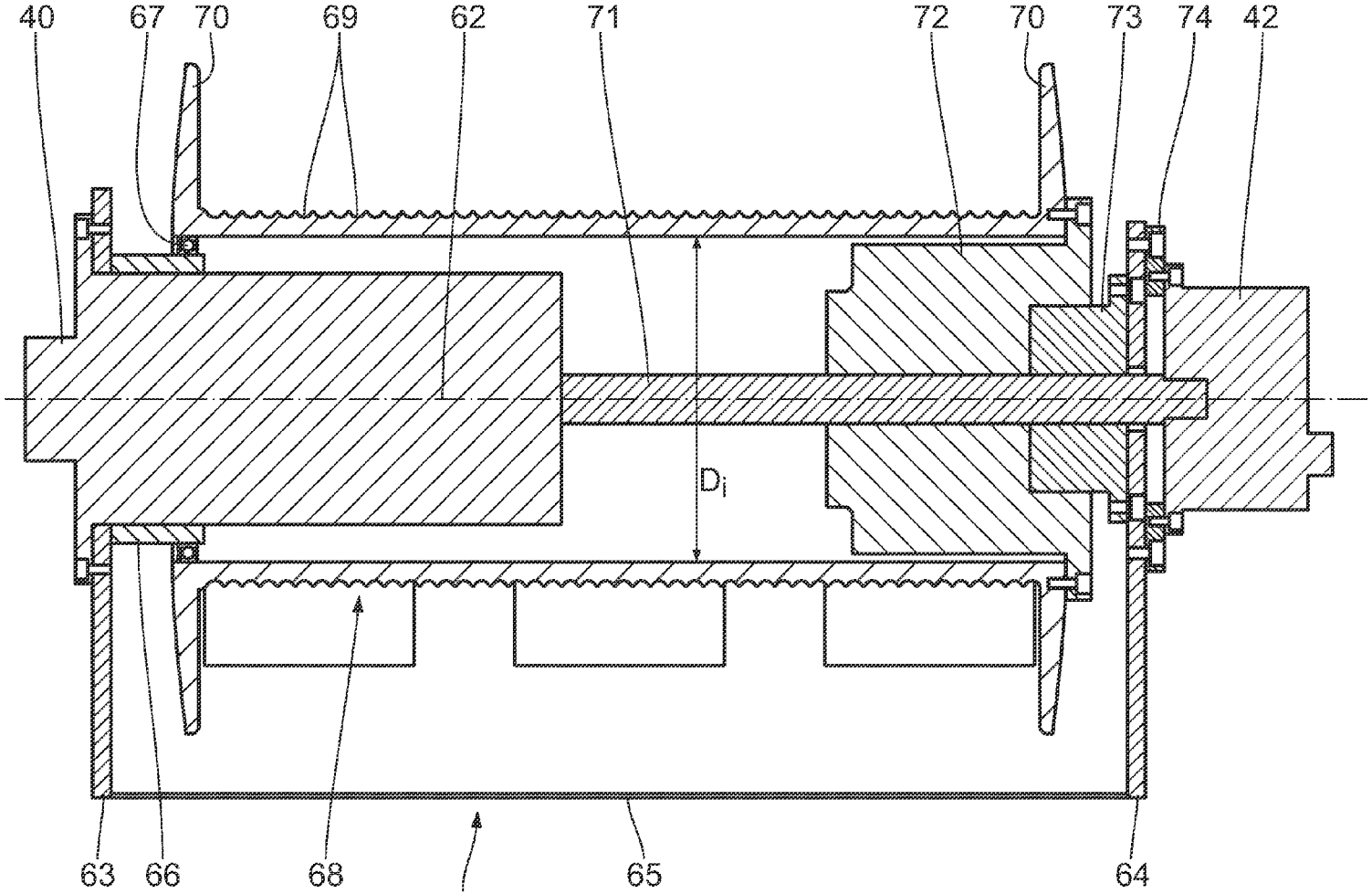
FIG. 9 shows a longitudinal section parallel to an axis of rotation of a cable winch of the crane according to FIG. 2.

The view in FIG. 9 therefore shows the possibility for operating, e.g., the cable winch 43. It is possible, on the one hand, to drive the cable winch by means of the electric motor 40 and the gear 73 to, for example, wind a cable onto the cable drum 68 and to lift a load. However, it is also possible, when lowering a load, to drive the electric motor 40 by means of the gear and the drive shaft 71 and to use it as a generator for generate electric power. In addition, the brake 42 is used, for example, to avoid the load coming off or a rotary movement of the cable drum 68 that is too fast, for safety reasons.

Figure 10:
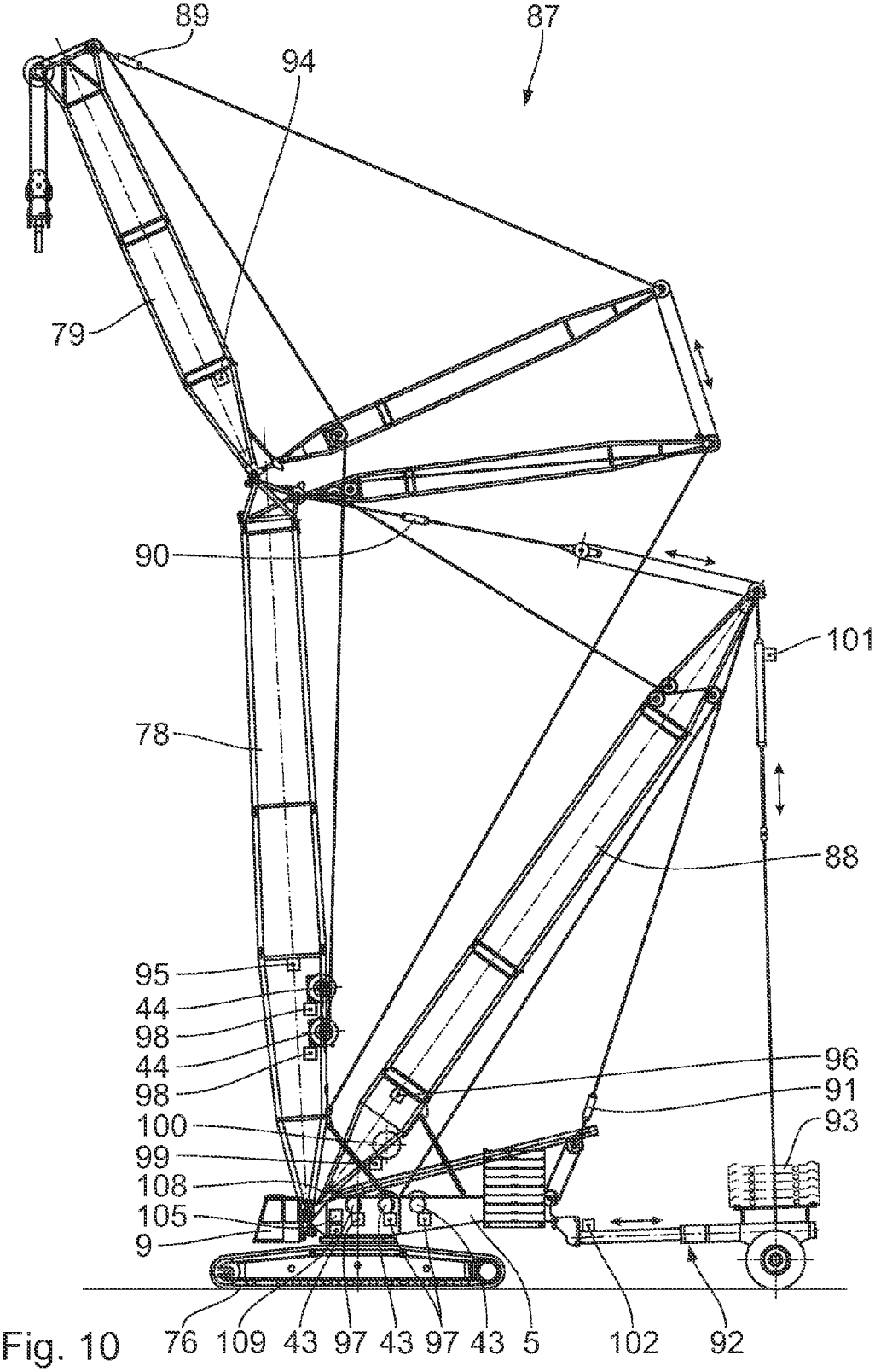
FIG. 10 shows a side view of a crawler crane according to a third embodiment with a superlift mast and with a counterweight carriage.

FIG. 10 shows an exemplary configuration of a further embodiment of a crane 87. Components corresponding to those previously explained in view of FIGS. 1 to 9 have same reference signs and are not again discussed in detail.

The essential difference of the crane 87 compared to the crane 75 as illustrated in FIGS. 2 and 3 is the setup of the crane 87 as a superlift crane comprising a superlift mast 88. Further, a counterweight carriage 92 is connected to the superstructure 5 of the crane 87, wherein an additional counterweight 93 is arranged on the counterweight carriage 92 separately from the superstructure 5.

In the following, based on schematic illustrated sensors in FIG. 10, a method is described which enables the operator to displace a load horizontally as well as vertically (not shown). The energy usage fraction that is necessary for driving the relevant crane components is provided by the cable winches 43 and/or by the luffing mechanisms 44. For that purpose, the operator defines a designated change of a position of the load or of a condition of the crane via an operator interface 107 that is connected to the control unit 34 (not shown in FIG. 9, see FIG. 8). The control unit 34 determines several energy parameters related to energy needs of each crane component of the crane 87. For that purpose, data regarding the following parameters are provided and submitted to the control unit: current data from force sensors 89, 90, 91 of the auxiliary boom 79, the main boom 78 and the superlift mast 88, data from angle transmitters 94, 95, 96 of the auxiliary boom 79, of the main boom 78 and of the superlift mast 88, the height of the load resulting from the crane geometry and from rotary encoders 97, 98, 99 of the cable winches 43, the luffing mechanisms 44 and a lifting device 100, data from length encoders 101, 102 for adjusting the superlift mast 88 and the counter weight carriage 92 and data of the energy loading condition of each of the crane components Said data of the energy loading condition is shown and therefore can be monitored via the operator interface 107 as shown in FIG. 4. Based on these data, a possible and energetic favourable path of motion and, in particular, a certain sequence of single motions is recommended by the control unit 34. For instance it is possible to define a start point and a target point of the load to be handled. Taking into account at least one obstacle, a virtual connecting line between the start point and the target point may be divided in a sequence of vertical and horizontal motions. Starting from the start point, firstly a maximum allowable vertical movement upwards is calculated. After that a sequence of horizontal movements in a horizontal plane parallel to the ground is provided, in particular above the at least one obstacle. In a last step, the load is lowered to the target point. Of course, other kinds of path-calculation are possible, for example, direct line-calculating, i.e., in which a shortest connection from the starting point to the target point may be used.

The concrete execution of crane motion for displacing the load can be realized by the operator by usage of different actuation modules for the single crane functions. With this strategy, in particular, a risk of accident and/or disturbance, e.g., due to deviations of an operating schedule, local circumstances in the form of interfering edges or demands of safety reasons, is reduced.

Furthermore, the operator can directly influence the energy management of the cranes 1, 75, 87 by understanding the energy needs and generating capability of each crane component. For instance, the operator may deliberate about whether a planned displacement of the load is possible or not without activation of the primary energy source 12. It is also possible with the energy management system to take into account the efficiency factors of each crane component. Since, for instance, a crawler track 76 has a smaller efficiency factor than a cable winch 43, a smaller necessary energy usage fraction would be postulated via the control unit 34 at the cable winch 43 in order to reduce energy loss. For instance, if it is planned to lift a load of known weight to a known height, the control unit 34 is able to calculate the amount of potential energy that has to be provided for such a lifting operation. Based on these data, the control unit 34 may further calculate a necessary amount of power. Thus, the potential for saving energy is enhanced.

It is further possible that the displacement of the load is first calculated and, if desired, simulated, and second, carried out automatically, i.e., the operator does not have to intervene into the process of load displacement. For such an operation mode, parameters, such as radius of the load, height of the load, position of the load, position of the superstructure and/or drive position of the undercarriage drive and/or of the counterweight 92 are calculated under the frame condition of an energetic favourable displacement of the load. Also boundary conditions necessary to assure safety can be integrated into the calculation in order to reduce a risk of collision during displacement of the load. In particular, for providing an autonomous displacement of the load in the embodiment of FIG. 10, an angle transmitter 105 on the superstructure 5 is advantageous for detecting the angular position of the superstructure 5 as well as, alternatively or additionally to the length encoders 101, a pressure transmitter 109 can be used for the determination of the angular position concerning an axis of rotation 108 of the superlift mast 88, whereas the axis of rotation 108 is perpendicular to the rotational axis 84. The angle transmitter 105 and the pressure transmitter 109 transmit the detected positions to the control unit 34 which uses them to control the autonomous displacement of the load. According to the pressure in the pressure transmitter 109, a certain position of the superlift mast 88 can be calculated, since the pressure in the pressure transmitter 109 is proportional to a angle position of the superlift mast 88 concerning the axis of rotation 108.

Cranes 1, 75, and 87 according to the embodiments shown thus allow savings in energy consumption and in emissions, in particular in intermittent operation, which characterises the conventional operation of a loading lifting means such as in the cranes 1, 75, and 87 shown here. In order to improve the efficiency of the primary energy source 12 in the form of the internal combustion engine, a self-cooling system, such as, for example, a heat exchanger to the air or an air cooling may be provided. Said self-cooling system is directly connected to the primary energy source 12 so that heat can be removed from the primary energy source 12. For that purpose, it is known that a cooler, e.g., a heat exchanger, is directly connected to primary energy source 12, thus arranged in its vicinity. To further reduce pollutants and the consumption of fossil fuels, it is possible to replace the internal combustion engine by fuel cells or for example, if the stop function is fulfilled, to operate the power consumer system 31 in mains operation, i.e., to use the external energy supply 59, or to use energy stored in the at least one energy storage unit 60. The control unit 34 may be used for this purpose, which, for example, detects the current energy usage fraction but also the current energy storage fraction of the energy system and evaluates it. The current energy usage fraction is that fraction of total energy amount that is currently used by the crane components. The current energy storage fraction is that fraction of total energy amount that is currently stored in the at least one energy storage unit 60. Both the energy storage fraction and the energy usage fraction may be determined or measured by the control unit 34.

By using the electric motors 40 instead of hydraulic drives, it is possible to achieve higher part efficiencies at the crane and therefore to improve the efficiency of the crane overall. Moreover, the stoppage times of the crane can be reduced. As the part efficiencies are higher by using electric motors 40 instead of hydraulic drives, it is possible to provide the same amount of energy with less operating time of the motors 40. Therefore, the overall demand of the motors 40 is reduced, so that stoppage times for repairing, maintenance and/or replacement of the motors 40 are reduced. Overall, the energy supply of the crane shown thus takes place diesel-electrically with one or more generators 21, preferably synchronous generators, which, in each case, by means of a converter 39, i.e., a frequency converter, feed electric energy, i.e., primary energy, into the power consumer system 31. The motors 40 are preferably synchronous motors and are supplied from the power consumer system 31.

Since, in particular a plurality of energy storage units 60 are connected to the power consumer system 31, it is possible store excess energy, in other words the energy storage fraction, and therefore to realise a temporary high power removal from the power consumer system 31. If the overall energy amount to be fed into the power consumer system 31 is greater than the sum of the energy usage fraction and energy storage fraction, the excess energy fraction can be reduced with additional brake resistance and be converted to thermal energy. It is basically also possible to return this excess energy via the generators 21 during motor operation to the internal combustion engine 12. The internal combustion engine could then, for example, during deceleration and optionally with additional brake devices, such as a flap brake or constant throttle, use that energy. As shown in FIG. 4, the control unit 34 is arranged centrally in the crane. It is also possible for a plurality of control units to be provided, which are arranged locally on the crane, i.e., the control units may be provided on the crane components.

The important advantages of this drive system are that all the crane components can be used simultaneously, independently of one another and in a directly controllable manner taking into account a maximum power available. Furthermore, it is possible to directly determine the drive power of the individual crane components. Moreover, it is possible to limit the drive power of the individual components and therefore to limit the overall power consumption of the crane. This could be realized for instance by the control unit 34, whereas a limit of drive power of the individual components is calculated by a maximum rotational speed of said components. Moreover, it is possible to be able to evaluate all the drives of the crane component with regard to their current energy state, their use and the operating period. As all the drives of the crane components are connected to the control unit 34 and said drives comprise corresponding sensors which enable the control unit 34 to detect a current position and further a current velocity of movement of the drive, e.g., rotational velocity or transversal velocity, it is possible to determine the current energy state of said components. Further, the use and the operating period of said components can be determined by the control unit 34. This allows a direct and simple load collective determination and a real-time state monitoring, so that critical states of the crane components can be recognised early and possible stoppages optionally avoided. As a result, stoppage times can be reduced and inherent energy states determined. If the crane is connected to the external power supply 59, it is possible to operate the crane free of emissions.

In a crane of this type its overall availability is improved and therefore the use period for an operator is increased. Since the crane components are only used if it is really necessary and also their usage is adjusted to maximum power requirements of the crane components, that means that the components are not run at maximum power for a longer time so that said components may collapse at an early stage of the crane life time, the rate of efficiency of the crane is increased. Four different operating modes are available, i.e., a standby mode 117, a semi-hybrid mode 118, a full-hybrid mode 119, and a full electric mode 120. As schematically shown in a flow chart of FIG. 8, it is possible to switch between said four operating modes during operation of the crane. For instance, the operator may directly choose one of said modes via the operator interface 107. The operator interface 107 creates a decision signal 116, based on which one of the modes is selected. For that purpose, the operator interface 107 is directly connected to the power consumer system 31 or alternatively connected to the power consumer system 31 via the control unit 34. Thus, it is possible to display the current energy management situation of the crane 1, 75, or 87 so that the operator may decide which of said modes may be the best for a current operating situation. Alternatively, it is also possible that said best mode is calculated by the control unit 34 based on current signals of the power consumer system 31 and attached crane components 9, 12, 43, 44, 45, 46, 47, 51, 52, 53, 54, 58 and 59. With this procedure, the selection of the best mode for operating the crane is automatic and therefore an effective and economic operation of the crane is guaranteed even if the operator does not monitor the operation of the crane the whole time. Further, the operator interface 107 enables the operator during the mooring-operation whether the electrical drives of the crane components 9, 12, 43, 44, 45, 46, 47, 51, 52, 53, 54, 58 and 59 are operated by control of rotation speed 127 or by control of moment of force 128. Said switch between operation modes for controlling the electrical drives of said crane components is usually decided by the operator. It is also possible, to develop rules for decision to be stored in the control unit 34 so that depending on a current load situation and based on said rules for decision the control unit 34 may send a switching signal via the operator interface 107 for choosing one of the operation modes 127, 128.

In the standby mode, various auxiliary functions, in particular electric drives, can even be activated by the secondary energy source during a stop function when the primary energy source 12 is deactivated. In the semi-hybrid mode, the primary energy source, for example, the internal combustion engine and the electric drives for the at least one crane component are used to generate energy to be used to run the crane. In the full-hybrid mode, energy reserves from the energy storage units, or electric energy from the secondary energy sources are preferentially used over the energy supplied from the primary energy source. The primary energy source, in particular with the use of the start-stop function, is only seldom required because of the intermittent operation of the crane, wherein, even in the activated state of the primary energy source, unused energy is not lost, but is stored by means of the energy storage units. The full-electric mode is one in which exclusively electric energy sources, i.e., fuel cells, photovoltaic systems, and/or batteries, are used as the energy storage units, or a mains power supply is used exclusively. As a result, pollutant emission and therefore noise emissions are completely eliminated.

Due to the combination of the four mentioned operating modes, it is ensured that the crane is available with a high degree of capacity utilisation, i.e., even upon a failure of one of the energy sources, the crane can be switched over to another of the operating modes. It may also be necessary, for example, to switch over the operating modes when, because of emission specifications, the internal combustion engine, for example, has to be deactivated or the external current supply network is no longer available. It is likewise not necessary to operate the crane at constant load, or, for example, to switch off the crane as a whole, if the stop condition is fulfilled. As a result, the useable life of the main crane components is extended and, the resell value of the crane may be increased. A switch over between the operating modes may take place, for example, by means of the control unit 34, which can either automatically detect which mode to use, or can be instructed to change between modes by operation of a switch or selection of a menu item by the crane operator.

Due to the additional provision of a plurality of simultaneously working safety devices, such as, for example, the load moment indicator 115 (LMI), the safety of the disclosed cranes is improved as well as the crane geometry, and forces inherent to the system and therefore latent energy potentials are detected. The LMI 115 is integrated part of the control unit 34 and schematically illustrated in FIG. 6. As is known, LMI 115 monitors the current load torque and guarantees that a known maximum value of the load torque is not exceeded by actively manipulating relevant parameters such as height of the load and radius of the load. Since the LMI 115 detects the current safety condition of the crane, information on the crane configuration, such as the loads, the pressures in the hydraulic or pneumatic cylinders, the hook and the load height can be examined, and the energy potentials of energy that could be recovered from each of the crane components can be directly determined and provided as electrical signals. Said electrical signals are shown to the operator via the operator interface 107. It is further also possible to use the electrical signals as control signals in the control unit 34 to submit the energy potentials as a parameter for the control unit 34. The energy potentials thus are energy reservoirs which are detected by LMI 115. Possible energy requirements are thus determined and possible work speeds forecast by means of the energy storage units. Above all, however, the LMI 115 allows a sensitive operation of the crane components which is effected by redundant LMI-control systems, which take into account the three degrees of freedom of the suspended load, determines this in real time and supplies it directly to the control unit as an electric control variable.

With the real-time state monitoring it is possible to easily and directly request load cycles, torques, and loads various locations on the crane and to use them for further information processing. The loads on the crane in all the sensed locations are totalled in order to determine a current maximum load of the crane and to monitor it. The real-time state monitoring is made possible by the input and output signals electrically provided from the various sensors to the control unit(s), which guarantees rapid data processing and communication. In conjunction with crane loads determined by means of the LMI 115, monitoring of the crane components is thus accomplished. For example, it is possible for an incompletely opened brake or a sluggish bearing to be recognised by a finding of an excessive power consumption of the corresponding crane component. The need for repairs can thus be easily recognized, and those then be quickly made to improve crane operations and safety.

To provide real-time state monitoring of the crane, input data for the control unit is provided as electrical data from the various LMI 115 and other sensors so that these data can easily and rapidly be processed by the control unit. Adequate energy management enables displaying the energy balance of the crane in real-time and therefore enhancing possible energy savings on the one hand and on the other hand creating a regulation of priorities for the management of all energy generating devices and energy consumer devices. Therefore, an LMI system is used that comprises electric, fail safe and redundant sensors for independent control of part sections of the crane. By this system, it is possible to unburden the crane operator, since sections of the crane are independently controlled by local, high-grade self-sufficient controls built as intelligent systems. Preferably this is provided by simulating the geometry of the crane or by lifting and lowering the load during low visibility conditions, e.g., fog, using the control unit 34. Controls that are not realized in real-time are not adequate for self-sufficient control of a crane due to safety reasons.

A further advantage of the usage of electric control data compared to mechanical or fluid-mechanical control data is the avoidance of transformation losses and therefore the avoidance of noise of signals during signal-conversion.

Although various features of the invention have been described with particular embodiments, it is considered within one of ordinary skill in the art to mix and match the features in other embodiments not depicted in the figures.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

The means, materials, and steps for carrying out various disclosed functions may take a variety of alternative forms without departing from the invention. Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

The invention claimed is:

1. A method for operating a crane, said crane comprising a power consumer system for providing energy; a primary energy source for feeding primary energy into a power consumer system; at least one secondary energy source, controllable independent from the primary energy source, for feeding secondary energy into the power consumer system, wherein the secondary energy source is connected to the power consumer system, and configured such that energy returned from operation of the at least one secondary energy source is at least partially fed as secondary energy into the power consumer system, said secondary energy source comprising at least one crane component; at least one energy storage unit arranged locally on the crane associated with the at least one crane component and connected to the power consumer system for storing primary energy and/or secondary energy; and at least one drive motor connected to the power consumer system for operating the at least one crane component in response to energy fed into the power consumer system, the method comprising:

activating, in a working operation of the crane, said at least one crane component;

deactivating, in a no-load operation of the crane, the at least one crane component;

wherein in the working operation said at least one crane component is working and wherein in the no-load operation, said at least one crane component is non-working;

providing a total energy amount comprising at least one of primary energy generated by means of said primary energy source and secondary energy generated by means of said at least one secondary energy source;

determining an energy usage fraction demanded by the at least one crane component;

controlling a ratio of the energy usage fraction to an energy storage fraction by a control unit, wherein the control unit is in signal connection with the power consumer system, the primary energy source and the at least one secondary source to control an energy supply to the at least one crane component, wherein the control unit is configured to cause secondary energy to be supplied to the at least one crane component to meet the energy usage fraction, and wherein the control unit is configured to cause secondary energy from the secondary source to be used preferentially over the primary energy supplied by the primary energy source to provide for the energy usage fraction; and storing the energy storage fraction in the at least one energy storage unit, wherein the total energy amount comprises the energy usage fraction and the energy storage fraction, and wherein the secondary energy is energy returned from operations performed by the at least one crane component.

2. The method according to claim 1, further comprising providing the energy usage fraction to the at least one crane component by feeding energy into the power consumer system.

3. The method of claim 1, further comprising providing the energy usage fraction to the at least one crane component using at least one energy converter connected to the at least one crane component to convert energy from operation of the at least one crane component into power.

4. A method of operating a crane, said crane comprising a power consumer system for providing energy; a primary energy source for feeding primary energy into the power consumer system; at least one secondary energy source, controllable independent from the primary energy source, for feeding secondary energy into the power consumer system, wherein the secondary energy source is connected to the power consumer system, and configured such that energy returned from operation of the at least one secondary energy source is at least partially fed as secondary energy into the power consumer system, said secondary energy source comprising at least one crane component; at least one energy storage unit arranged locally on the crane associated with the at least one crane component and connected to the power consumer system for storing primary energy and/or secondary energy; and at least one drive motor connected to the power consumer system for operating the at least one crane component in response to energy fed into the power consumer system, the method comprising the following steps:

providing a total energy amount comprising at least one of primary energy generated by means of said primary energy source and secondary energy generated by means of said at least one secondary energy source;

determining an energy usage fraction demanded by the at least one crane component, wherein the amount of the demanded energy usage fraction of the at least one crane component is previously known;

controlling a ratio of the energy usage fraction to an energy storage fraction by a control unit, wherein the control unit is in signal connection with the power consumer system, the primary energy source and the at least one secondary source to control an energy supply to the at least one crane component, wherein the control unit is configured to control the power consumer system for supplying the energy usage fraction preferentially to at least one crane component over another crane component, and storing an energy storage fraction in said at least one energy storage unit, wherein the total energy amount comprises the energy usage fraction and the energy storage fraction, and wherein the secondary energy is energy returned from operations performed by the at least one crane components.

5. The method according to claim 4, further comprising the step of providing the energy usage fraction to the at least one crane component by causing energy to be fed into the power consumer system.

6. The method according to claim 4, further comprising the steps of:

converting energy from operation of the at least one crane component into power using at least one energy converter connected to the at least one crane component, and providing the energy usage fraction to the at least one crane component using the power from the at least one energy converter.

7. The method according to claim 6, further comprising the step of determining an excess energy fraction such that a sum of the energy usage fraction and a maximum energy storage fraction is equal to a sum of the excess energy fraction and the total energy amount.

8. The method according to claim 4, further comprising the step of controlling the supply of energy to the at least one crane component by controlling a ratio of the energy usage fraction to the energy storage fraction.

* * * * *